US007942262B2

(12) United States Patent
Watanabe et al.

(10) Patent No.: US 7,942,262 B2
(45) Date of Patent: May 17, 2011

(54) PACKAGING STRUCTURE FOR BUILDING BOARDS AND BUILDING BOARDS LOADING STRUCTURE

(75) Inventors: Masaru Watanabe, Nagoya (JP); Yoshinori Hibino, Ama-gun (JP)

(73) Assignee: Nichiha Corporation, Nagoya-shi (JP)

( * ) Notice: Subject to any disclaimer, the term of this patent is extended or adjusted under 35 U.S.C. 154(b) by 141 days.

(21) Appl. No.: 12/003,617

(22) Filed: Dec. 28, 2007

(65) Prior Publication Data

US 2008/0210139 A1 Sep. 4, 2008

(30) Foreign Application Priority Data

Jan. 12, 2007 (JP) ..... 2007-000091
Mar. 20, 2007 (JP) ..... 2007-001844

(51) Int. Cl.
*B65D 85/46* (2006.01)
*B65D 19/00* (2006.01)
*B65D 71/00* (2006.01)
*B65D 85/00* (2006.01)

(52) U.S. Cl. ..... 206/321; 206/83.5; 206/442; 206/597

(58) Field of Classification Search ..... 206/83.5, 206/321–325, 442, 449, 451, 499, 597, 600, 206/386, 821
See application file for complete search history.

(56) References Cited

U.S. PATENT DOCUMENTS 1,675,147 A * 6/1928 Walter ..... 206/325
1,770,516 A * 7/1930 Griffith ..... 206/451
1,873,887 A * 8/1932 Heppes ..... 206/451
2,287,056 A * 6/1942 Owens ..... 206/597
2,535,422 A * 12/1950 Jones ..... 206/321
2,566,385 A * 9/1951 Van Patten ..... 206/597
2,664,813 A * 1/1954 Rose ..... 206/321
3,227,357 A * 1/1966 Knapp et al. ..... 206/597
3,348,673 A * 10/1967 Bahls et al. ..... 206/597
3,473,654 A * 10/1969 Zimmerman ..... 206/597
3,709,326 A * 1/1973 Habgood, Jr. ..... 206/386
4,317,517 A * 3/1982 Tisdale ..... 206/597
4,483,438 A * 11/1984 Kobiella ..... 206/597
5,862,912 A * 1/1999 Schelhorn ..... 206/321
6,926,142 B2 * 8/2005 Powers et al. ..... 206/321

FOREIGN PATENT DOCUMENTS

JP 2005-231713 9/2005

* cited by examiner

*Primary Examiner* — Bryon P Gehman

(74) *Attorney, Agent, or Firm* — Kratz, Quintos & Hanson, LLP

(57) ABSTRACT

A building boards loading structure which loads plural building boards, being similar sheets, on a pallet. The building boards loading structure has plural packages, and the packages have plural building boards and plural bands. The plural building boards are banded at plural locations by the plural bands, and the plural packages are stacked vertically, to provide an upper and lower package in regard to two packages, and loaded on a pallet. The locations of bands in each upper and lower package which is loaded on the pallet are different from each other in relation to the lateral direction. The location of bands in a lowest package which is loaded on the pallet is different, in relation to the lateral direction, from the location of the stringers and an entry in the pallet for inserting a fork of a fork lift truck.

2 Claims, 17 Drawing Sheets

( a )

( b )

( a )

( b )

( a )

( b )

( a )

( b )

( a )

( b )

PACKAGING STRUCTURE FOR BUILDING BOARDS AND BUILDING BOARDS LOADING STRUCTURE

BACKGROUND OF THE INVENTION

1. Field of the Invention

The present invention relates to a packaging structure for building boards used for an external wall or interior wall of a house and a building boards loading structure.

2. Description of the Related Art

The following description sets forth the inventor's knowledge of related art and problems therein and should not be construed as an admission of knowledge in the prior art.

In general, a building board is used for wall material or roofing material of a house.

As for the building board, a package is applied for protecting it from breakage and dirt when it is kept and it is carried in an installation site. In consideration of workability, it is general to pack two or three building boards in one package, the plural packages are loaded on a pallet, and it is kept or it is carried.

In general, for a pallet to be loaded with the plural packages, as shown in FIG. 17, plural stringers 10 are arranged by predetermined spacing, and plural deck boards 11 are fixed by nail on a top face and undersurface of the stringer 10. Entry 12 to insert a fork of a fork lift truck is made from the stringer 10 and the deck board 11 is installed in the pallet. The package is loaded on the pallet, and the package can be moved with a fork lift truck by inserting a fork of a fork lift truck in entry 12.

In addition, there are numerical quantities of building board loaded pallets which are different by weight, shape and thickness. Furthermore, when it is transported to an installation site, a picking up work operation is performed to adjust the building boards to the numerical quantity that is necessary.

As a representative example of the above described building board, there is a rectangle-shaped fiber reinforced cement siding having 455 mm of width and 1500-3030 mm of overall length and 9-25 mm of thickness. In the case of the above described fiber reinforced cement siding, a fiber reinforced cement siding which has a surface (a design patent side) and an under face on the back side is piled up on another fiber reinforced cement siding having a surface of a top face, and one packaging structure is made of the two fiber reinforced cement sidings. So, each other's surface of the fiber reinforced cement siding is made face-to-face, and it is not exposed. Therefore, each other's surface of the fiber reinforced cement siding is protected. In addition, in the case of fiber reinforced cement siding having a convexoconcave shank design in the surface or having a coating surface, the surface is protected more by using inserting paper between the two fiber reinforced cement sidings. A size of the inserting paper to use for this case is more massive than the size of the whole surface of the above described fiber reinforced cement siding.

FIG. 14 is a view which shows a packaging structure for building boards and a building boards loading structure according to a related art. FIG. 14 (*a*) shows a perspective view of package A141 of fiber reinforced cement sidings 1 as building boards, FIG. 14 (*b*) shows a perspective view of a loading structure having loaded pallet B with packages A141.

As shown in FIG. 14 (*a*), package A141 has a structure in which two pieces of fiber reinforced cement siding 1 are piled up to be sandwiching an inserting paper 2, and it is covered overall by shrink film 6, as shown in FIG. 14 (*b*), packages A141 are loaded on pallet B with two lines.

FIG. 15 is a view which shows a packaging structure for building boards and a building boards loading structure according to a related art (Japanese Patent Laid-Open No. 2005-231713 is referred to). FIG. 15 (*a*) shows a perspective view of package A151 of fiber reinforced cement sidings 1 as building boards, FIG. 15 (*b*) shows a perspective view of a loading structure having loaded pallet B with packages A151.

As shown in FIG. 15 (*a*), package A151 has a structure with two pieces of fiber reinforced cement siding 1 piled up with attaching paper cushioning material 5, 5 on either side of a longer direction of the two pieces of fiber reinforced cement siding 1, and capping paper cap 7,7 on either side of a short direction of the two pieces of fiber reinforced cement siding 1, and banding of two pieces of the fiber reinforced cement siding 1 by plural polypropylene-made bands 3. As shown in FIG. 15 (*b*), packages A151 is a loaded pallet B with two lines, and a location of polypropylene-made band 3 banding package A151 is the same in all package A151.

FIG. 16 is a view which shows a packaging structure for building boards and a building boards loading structure according to a related art (Japanese Patent Laid-Open No. 2005-231713 is referred to). FIG. 16 (*a*) shows a perspective view of package A161 of fiber reinforced cement sidings 1 as building boards, FIG. 16 (*b*) shows a perspective view of a loading structure having loaded pallet B with packages A161.

As shown in FIG. 16 (*a*), package A161 has a structure in which two pieces of fiber reinforced cement siding 1 are piled up with banding at ends of two pieces of fiber reinforced cement siding 1 by shrink film 6,6. In this case, shrink film 6 is heated, and it shrinks. Furthermore, a slip resistance means using hot melt 8 is put on a top of shrink film 6. And, as shown in FIG. 16 (*b*), packages A161 are loaded on pallet B with two lines.

However, in package A141 and the loading structure shown in FIG. 14, there is no point for catching package A141, so it is difficult to pick up package A141 from pallet B. In addition, when plural packages A141 are loaded, it is difficult to pick up package A141 because a shrink film 6 of package A141 is made to stick to another shrink film 6 by static electricity which occurs by rubbing.

Furthermore, a work operation which opens package A141 to use the fiber reinforced cement siding 1 at an installation site is necessary. In the packaging structure of package A141, shrink film 6 must be stripped, and fiber reinforced cement siding 1 must be transferred to another pallet for removing stripped shrink film 6, so that an effort and time are needed for this operation.

Furthermore, shrink film 6 after stripping is unnecessary so that it becomes industrial waste, and it is uneconomical.

On the other hand, in package A151 and the loading structure shown in FIG. 15, it is easy to pick up package A141 from pallet B by catching the polypropylene-made band which bands ends of the two pieces of fiber reinforced cement siding 1. In addition, at an installation site, a work operation which strips and removes shrink film 6 of package A151 is unnecessary and a problem that shrink film 6 after stripping becomes industrial waste does not occur.

However, package A151 uses paper cap 7, so that a packaging cost rises, and productivity in the factory falls. In addition, at an installation site, paper cap 7 must be stripped of package A151, and the fiber reinforced cement siding 1 must be transferred to another pallet for removing stripped paper cap 7, so that an effort and time are needed for an operation. Furthermore, paper cap 7 after stripping is unnecessary so that it becomes industrial waste, and it is uneconomical.

Furthermore, a location of polypropylene-made band 3 banding package A151 is the same in all packages A151, as shown in FIG. 15 (*b*), plural packages A151 are loaded on pallet B, and only one point of polypropylene-made band 3 becomes a point to rise from other points, by piling up plural polypropylene-made bands 3, so that a load tends to be concentrated at a point of polypropylene-made band 3. It is remarkable for lifting pallet B which loads plural packages A151. It makes unfavorable brightness and micro cracks at the surface of the fiber reinforced cement siding 1, and it might lose a good appearance and the good quality of the fiber reinforced cement siding 1.

In addition, an antislip agent is not applied between each package A151 loaded and, package A151 is mobile when receiving a force, so that the loading structure shown in FIG. 15 is easy to collapse.

Furthermore, in package A161 and the loading structure shown in FIG. 16, packing material is only shrink film 6 with bands at both ends of package A161 and hot melt 8, thus packaging cost can be low and controlled. But when package A161 is picked up, package A161 bends greatly because package A161 bands only at both ends, so that the fiber reinforced cement siding 1 might be damaged during a picking up operation. In addition, it is difficult to pick up shrink film 6 because it was heated and shrinks.

Furthermore, a location of shrink film 6 banding package A161 and hot melt 8 are the same in all package A161, as shown in FIG. 16 (*b*). Plural packages A161 are loaded on pallet B, and only one point of shrink film 6 becomes a point to rise from other points, by piling up plural shrink films 6 and hot melt 8, so that a load tends to be concentrated at a point of shrink film 6. It is remarkable for lifting pallet B which loads plural packages A161. As in the loading structure of FIG. 15, it makes unfavorable brightness and micro cracks at a surface of the fiber reinforced cement siding 1, and it might lose a good appearance and quality of the fiber reinforced cement siding 1.

The description herein of advantages and disadvantages of various features, embodiments, methods, and apparatus disclosed in other publications is in no way intended to limit the present invention. For example, certain features of the preferred embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

The preferred embodiments of the present invention have been developed in view of the above-mentioned and/or other problems in the related art. The preferred embodiments of the present invention can significantly improve upon existing methods and/or apparatuses.

Among other potential advantages, some embodiments can provide a packaging structure for building boards and a building boards loading structure, which is hard to collapse, and which does not make unfavorable brightness and micro cracks at a surface of the building boards, and its packaging cost is low, and its productivity and picking up workability do not deteriorate, and workability at an installation site is preferable, and industrial waste after unpacking is little.

According to some embodiments of the present invention, in a packaging structure for building boards which packs plural building boards in one package, the packaging structure comprises a plural of building boards and plural bands, and the plural of building boards are banded at plural locations by the plural bands, and a surface of the bands which are located at both ends of the packaging structure is adhesive, and a surface of band which are located at both ends of the packaging structure is non-adhesive.

An example of the band in which the surface is adhesive is a resin-made film such as stretch film and shrink film having a tacky producer in the surface, a resin-made band such as a band made of polypropylene and polyethylene having a tacky producer in the surface. On the other hand, an example of the band in which the surface is non-adhesive is a resin-made film having no tacky producer in the surface and a resin-made band having no tacky producer in the surface. In addition, the tacky producer always has tackiness in an absence of a solvent condition, and an example of the tacky producer is crude-rubber and synthetic rubber, acryl, and liquid aliphatic hydrocarbon.

When plural packages having said packaging structure are loaded on a pallet, a surface of the bands located at both ends of the package is adhesive, so that it is hard to collapse because of sticking of the bands. And when a surface of the band which is located between both ends of the packaging structure is non-adhesive, cutting the band and difficulty of picking up caused by sticking of the band to another band does not occur.

Furthermore, it is a minimum package, so that packaging cost is cheap, and productivity does not deteriorate. Unpacking at an installation site is only by cutting the plural bands, and it is not necessary to transfer plural building boards to another pallet, and industrial waste after unpacking is little. And it is easy to pick up a package from a pallet by catching the band.

Furthermore, in the packaging structure for building boards, a band is located between both ends of the packaging structure and bands the building boards helically.

In the packaging structure, the band is located between both ends of the packaging structure and bands the building boards helically, so that a banding force of the package becomes strong. And, even if force was added to the package from the outside, upper and lower building boards slipping off in the package is controlled.

According to some embodiments of the present invention, in a packaging structure for building boards which packs plural building boards in one package, the packaging structure comprises plural building boards and plural bands, and the plural building boards are banded at plural locations by the plural bands, and a surface of all bands is adhesive.

An example of the band in which the surface is adhesive is a resin-made film having a tacky producer in the surface and a resin-made band having a tacky producer in the surface.

When plural packages having said packaging structure are loaded in a pallet, a surface of all bands in the package is adhesive, so that it is hard to collapse because of sticking of the bands.

Furthermore, it is a minimum package, so that packaging cost is cheap, and productivity does not deteriorate. Unpacking at an installation site is only cutting the plural bands, and it is not necessary to transfer plural building boards to another pallet, and industrial waste after unpacking is little. And, it is easy to pick up a package from a pallet by catching the band.

Furthermore, in the packaging structure for building boards, a band which is located between both ends of the packaging structure bands the building boards helically.

In the packaging structure, the band which is located between both ends of the packaging structure bands the building boards helically, so that a banding force of the package by the band becomes strong. And, even if a force was added to the package from the outside, upper and lower building boards slipping off in the package is controlled.

Furthermore, in the packaging structure for building boards, the bands are resin-made film.

By using resin-made film as the band, a package having the packaging structure is banded enough, and an effect of the invention can be shown. In addition, resin-made film is more flexible than a resin-made band, and a thickness of the resin-made film is thin, so that a load by banding building boards can be minimized, and unfavorable brightness and micro cracks at the surface of the building boards is controlled.

According to some embodiments of the present invention, in a building boards loading structure which loads plural building boards on a pallet, the building boards loading structure comprises plural packages, and the package comprises plural building boards and plural bands, and the plural building boards are banded at plural locations by the plural bands, and the plural packages are loaded on the pallet, and the location of bands in each upper and lower package which is loaded on the pallet is different from each other.

An example of the band is a resin-made film such as stretch film and shrink film, a resin-made band such as a band made of polypropylene and polyethylene, a paper-made band and a cloth-made band.

In the building boards loading structure, the location of the bands in each upper and lower package which is loaded on the pallet is different from each other, so that it prevents a load from concentrating the location of the bands, and it does not make unfavorable brightness and micro cracks at the surface of the building boards.

And, even if using resin-made film as a band of the package, cutting the band and difficulty of picking up by sticking of the band to another band does not occur.

Furthermore, it is a minimum package, so that packaging cost is cheap, and productivity does not deteriorate. Unpacking at an installation site is only cutting the plural bands, and it is not necessary to transfer plural building boards to another pallet, and industrial waste after unpacking is little. And, it is easy to pick up a package from the pallet by catching the band.

Furthermore, in the building boards loading structure at least one of the bands bands the building boards helically.

A resin-made film such as stretch film and shrink film, a resin-made band such as a band made of polypropylene and polyethylene, a paper-made band and a cloth-made band are used as the band. Especially, using the resin-made film as the band is preferable.

In the packaging structure, at least one of the bands bands the building boards helically, so that the banding force of the package by bands becomes strong. And, even if a force was added to the package from the outside, upper and lower building boards slipping off in the package is controlled.

Furthermore, in the building boards loading structure, the pallet comprises plural stringers and plural deck boards, and the plural stringers and plural deck boards make an entry to insert a fork of a fork lift truck, and the location of bands in a lowest package which is loaded on the pallet is different from an upper location of the stringers and inserting fork of the fork lift truck.

In the building boards loading structure, the effect is that it prevents a load from concentrating at the location of bands and it does not make unfavorable brightness and micro cracks at the surface of the building boards is increased.

According to some embodiments of the present invention, in a building boards loading structure which loads plural building boards on a pallet, the building boards loading structure comprises plural packages, and the package comprises plural building boards and plural bands, and the plural building boards are banded at plural locations by the plural bands, and the plural packages are loaded on the pallet, and the pallet comprises plural stringers and plural deck boards, and the plural stringers and plural deck boards make an entry to insert a fork of a fork lift truck, and the location of the bands in a lowest package which is loaded on the pallet is different from an upper location of the stringers and the inserting fork of the fork lift truck.

A resin-made film such as stretch film and shrink film, a resin-made band such as a band made of polypropylene and polyethylene, a paper-made band and a cloth-made band are used as the band.

When the pallet loaded with the package moves with a fork lift truck, the load tends to be concentrated at a point of an upper location of the stringers and the inserting fork of the fork lift truck.

However, in the building boards loading structure, the location of bands in a lowest package which is loaded on the pallet is different from an upper location of the stringers and the inserting fork of the fork lift truck, so that it prevents a load from concentrating at the location of the bands, and it does not make an unfavorable brightness and micro cracks at the surface of the building boards.

Furthermore, it is a minimum package, so that packaging cost is cheap, and productivity does not deteriorate. Unpacking at an installation site is only cutting the plural bands, and it is not necessary to transfer plural building boards to another pallet, and industrial waste after unpacking is little. And, it is easy to pick up the package from the pallet by catching the band.

Furthermore, in the building boards loading structure the bands are resin-made film and/or a resin-made band.

An example of the band is a resin-made film such as stretch film and shrink film, and a resin-made band such as a band made of polypropylene and polyethylene.

By using a resin-made film and/or resin-made band as the band, a package is banded enough, and the effect of the invention can be shown.

According to some embodiments of the present invention, in a building boards loading structure which loads plural building boards on a pallet, the building boards loading structure comprises plural packages, and the package comprises plural building boards and plural bands, and the plural building boards are banded at plural locations by the plural bands, and a surface of bands which are located at both ends of the package is adhesive, and the plural packages are loaded on the pallet, and the pallet comprises plural stringers and plural deck boards, and the plural stringers and plural deck boards make an entry to insert a fork of a fork lift truck, and the location of the bands at both ends of the package in each upper and lower package which is loaded on the pallet is the same, and it is different from an upper location of the stringers and the inserting fork of the fork lift truck.

In the building boards loading structure, a surface of bands which are located at both ends of the package which is loaded on the pallet is adhesive, and the location of the bands at both ends of the package in each upper and lower package which is loaded on the pallet is the same, so that it is hard to collapse because of sticking of the bands.

If a location of the bands in the package in each upper and lower package which is loaded on the pallet is the same, a point of the bands becomes a point to rise from other points by piling up plural bands, so that a load tends to be concentrated at a point of the band. It is remarkable for lifting a pallet which loads plural packages. However, in the building boards loading structure, a location of bands at both ends of the package in each upper and lower package which is loaded on the pallet is different from an upper location of the stringers and an inserting fork of the fork lift truck, so that it prevents a load from concentrating at the location of the bands, and it does not make unfavorable brightness and micro cracks at the surface of the building boards.

Furthermore, it is a minimum package, so that packaging cost is cheap, and productivity does not deteriorate. Unpacking at an installation site is only cutting the plural bands, and it is not necessary to transfer plural building boards to another pallet, and industrial waste after unpacking is little. And, it is easy to pick up the package from pallet by catching the band.

Furthermore, in the building boards loading structure the location of the bands between both ends of the package in a lowest package which is loaded on the pallet is different from an upper location of the stringers and the inserting fork of the fork lift truck.

In the building boards loading structure, the location of the bands between both ends of the package in a lowest package which is loaded on the pallet is different from an upper location of the stringers and the inserting fork of the fork lift truck, it prevents a load from concentrating at the location of all bands and it does not make unfavorable brightness and micro cracks at the surface of building boards.

Furthermore, in the building boards loading structure the location of the bands between both ends of the package in each upper and lower package which is loaded on the pallet is different from each other.

In the building boards loading structure, the location of bands between both ends of the package in each upper and lower package which is loaded on the pallet is different from each other, it prevents a load from concentrating at the location of all the bands and it does not make unfavorable brightness and micro cracks at the surface of the building boards.

And, even if using a band having an adhesive surface, cutting the band and difficulty of picking up caused by sticking of the band to another band does not occur.

Furthermore, in the building boards loading structure the bands are resin-made film.

An example of the resin-made film is stretch film and shrink film.

By using resin-made film as the band, a package is banded enough, and the effect of the invention can be shown.

EFFECT OF THE INVENTION

According to the present invention, it is a minimum package, so that packaging cost is cheap, and productivity does not deteriorate.

In addition, it prevents a load from concentrating at the location of the band and it does not make unfavorable brightness and micro cracks at the surface of the building boards.

Furthermore, unpacking at an installation site is only cutting the plural bands, and it is not necessary to transfer plural building boards to another pallet, and industrial waste after unpacking is little and workability at an installation site is preferable. And, it is easy to pick up a package from the pallet by catching the band.

Furthermore, in the building boards loading structure, a surface of the bands which are located at both ends of the package which is loaded on the pallet is adhesive, and the location of the bands at both ends of the package in each upper and lower package which is loaded on the pallet is the same, so that it is hard to collapse because of sticking of the bands.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or a feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which.

DESCRIPTION OF THE PREFERRED EMBODIMENTS

In the following paragraphs, some preferred embodiments of the invention will be described with reference to the attached drawings by way of example and not limitation. It should be understood based on this disclosure that various other modifications can be made by those in the art based on these illustrated embodiments.

A packaging structure for building boards and a building boards loading structure according to a preferable embodiment of the present invention will be explained with reference to FIGS. 1 to 13.

Embodiment 1

Figure 1:
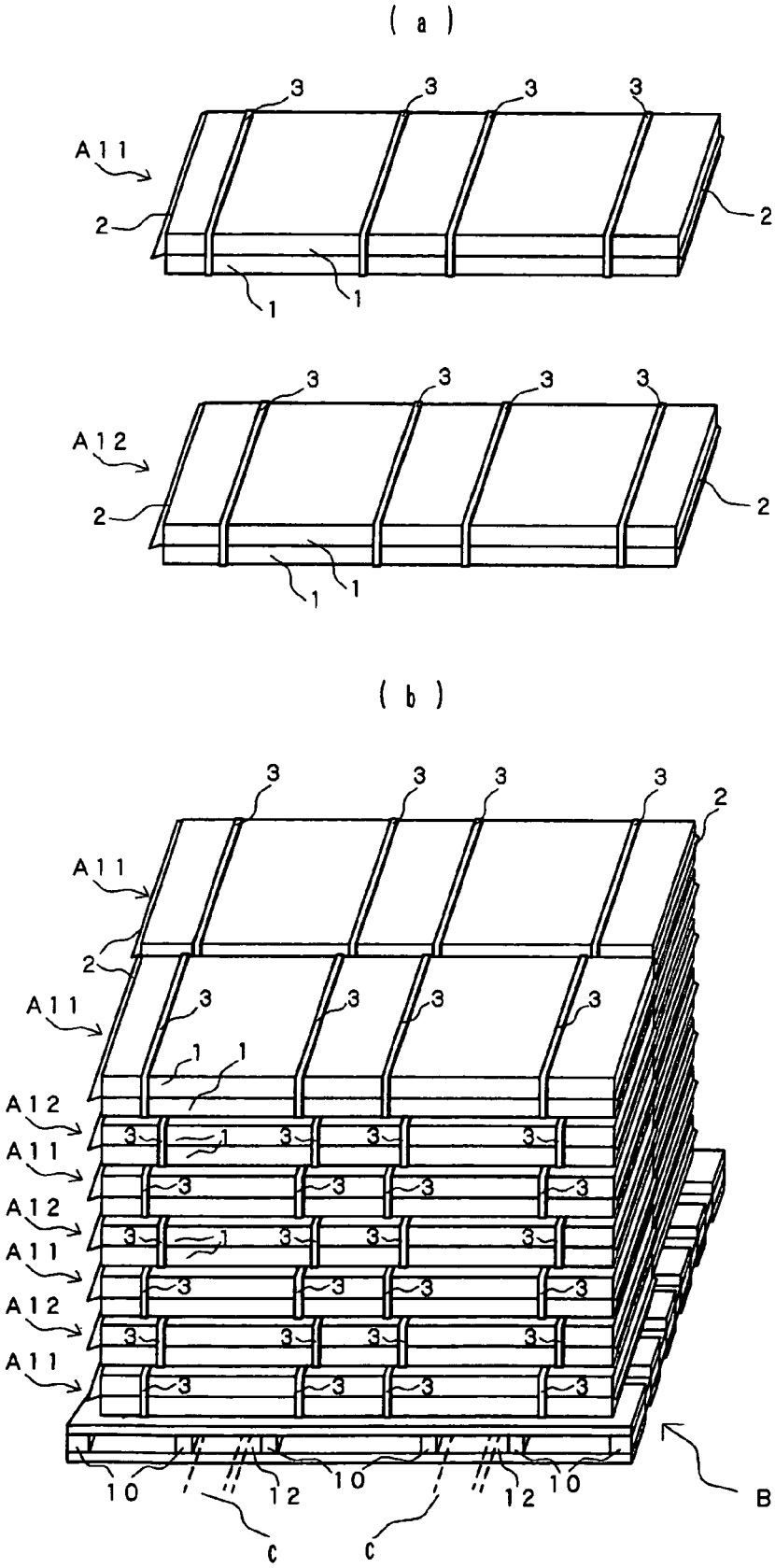
FIG. 1 is a view which shows a packaging structure for building boards and a building boards loading structure according to the first embodiment of the present invention.

FIG. 1 is a view which shows a packaging structure for building boards and a building boards loading structure according to the first embodiment of the present invention. FIG. 1 (*a*) shows a perspective view of packages A11 and A12 of fiber reinforced cement sidings 1 as building boards, and FIG. 1 (*b*) shows a perspective view of a loading structure with loaded pallet B having packages A11 and A12.

As shown in FIG. 1 (*a*), packages A11 and A12 have a structure in which two pieces of fiber reinforced cement siding 1 are banded by plural polypropylene-made bands 3. As an example, a number of polypropylene-made bands 3 in one package which is package A11 or A12 is four. When packages A11 and A12 are loaded on pallet B, a location of the polypropylene-made bands 3 is different from an upper location of the stringers and an inserting fork C of a fork lift truck. In addition, packages A11 and A12 are different from a location of the polypropylene-made bands 3, so that a location of the polypropylene-made bands 3 in each upper and lower package which is loaded on the pallet is different from each other by loading a package A11 with a package A12 alternately. As shown in FIG. 1 (*b*), packages A11 and A12 are arranged in two lines, wherein packages A11 and A12 are loaded on pallet B alternately, so that a location of the polypropylene-made bands 3 in each upper and lower package which is loaded on the pallet is different from each other, and a location of the polypropylene-made bands 3 is different from an upper location of the stringers 10 and the inserting fork C of a fork lift truck. Therefore, it prevents a load from concentrating at the location of all the polypropylene-made bands 3 and it does not make an unfavorable brightness and micro cracks at the surface of the fiber reinforced cement sidings 1.

And, it is easy to pick up packages A11 and A12 from pallet B by catching the polypropylene-made band 3.

Furthermore, packages A11 and A12 are minimum packages, so that packaging cost is cheap, and productivity does not deteriorate. Unpacking at an installation site is only cutting the plural polypropylene-made bands 3, and it is not necessary to transfer plural fiber reinforced cement sidings 1 to another pallet, and industrial waste after unpacking is little.

Embodiment 2

Figure 2:
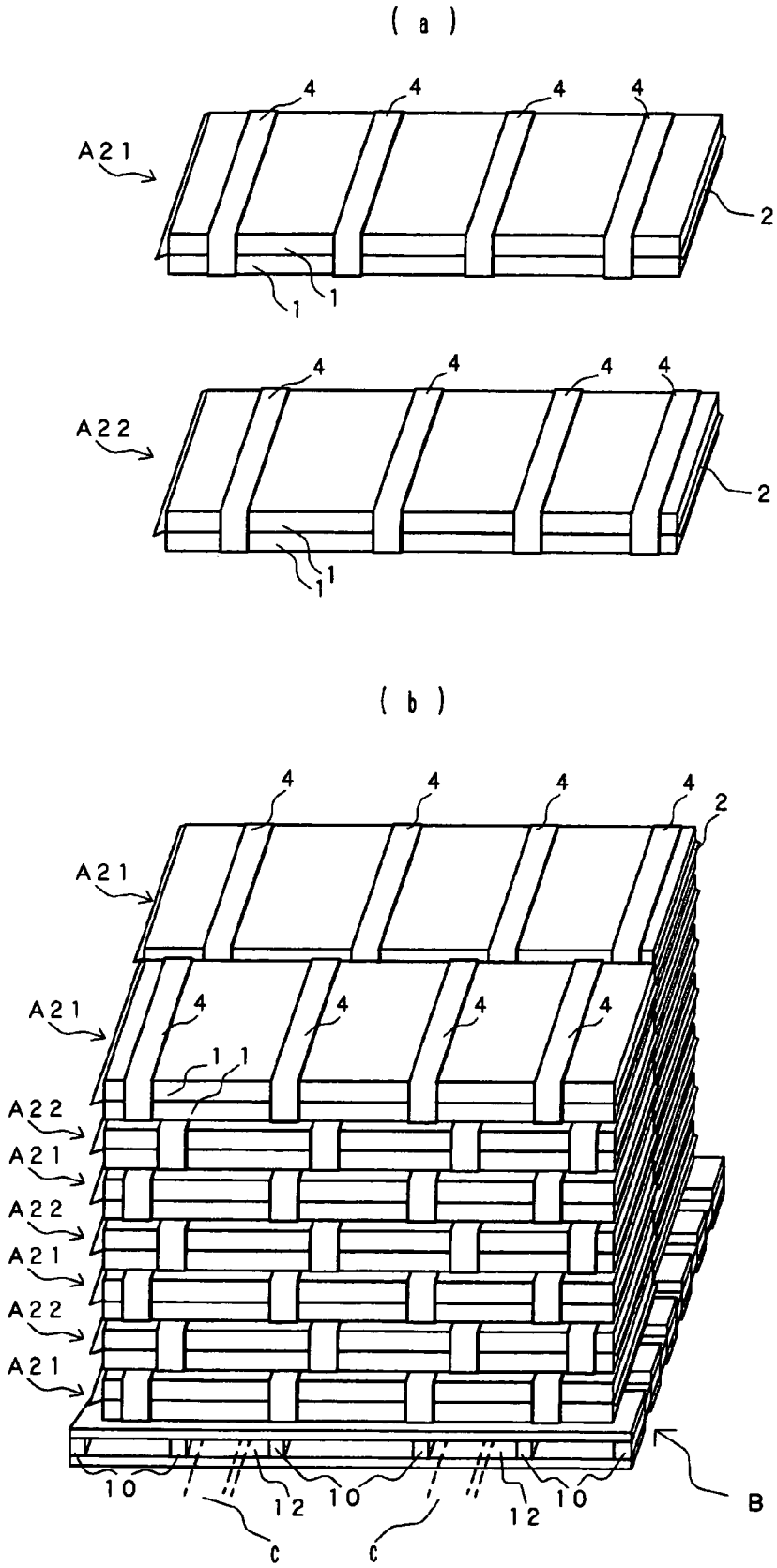
FIG. 2 is a view which shows a packaging structure for building boards and a building boards loading structure according to the second embodiment of the present invention.

FIG. 2 is a view which shows a packaging structure for building boards and a building boards loading structure according to the second embodiment of the present invention. FIG. 2 (*a*) shows a perspective view of packages A21 and A22 of fiber reinforced cement sidings 1 as building boards, and FIG. 2 (*b*) shows a perspective view of a loading structure with loaded pallet B having packages A21 and A22.

As shown in FIG. 2 (*a*), packages A21 and A22 have a structure in which two pieces of fiber reinforced cement siding 1 are banded by plural stretch films 4. As an example, a number of stretch films 4 in one package which is package A21 or A22 is four. However, packages A21 and A22 are different from a location of stretch films 4, so that the location of stretch films 4 in each upper and lower package which is loaded on the pallet B is different from each other by loading a package A21 with a package A22 alternately. As shown in FIG. 2 (*b*), packages A21 and A22 are arranged in two lines, wherein packages A21 and A22 are loaded on pallet B alternately, so that a location of stretch films 4 in each upper and lower package which is loaded on the pallet is different from each other. Therefore, it prevents a load from concentrating at the location of all the stretch films 4 and it does not make an unfavorable brightness and micro cracks at the surface of the fiber reinforced cement sidings 1. And, cutting the band and a difficulty of picking up by sticking of the band to another band does not occur.

And, it is easy to pick up package A21 and A22 from pallet B by catching the stretch film 4.

Furthermore, packages A21 and A22 are minimum packages, so that packaging cost is cheap, and productivity does not deteriorate. Unpacking at an installation site is only cutting the plural stretch films 4, and it is not necessary to transfer plural fiber reinforced cement sidings 1 to another pallet, and industrial waste after unpacking is little.

Embodiment 3

Figure 3:
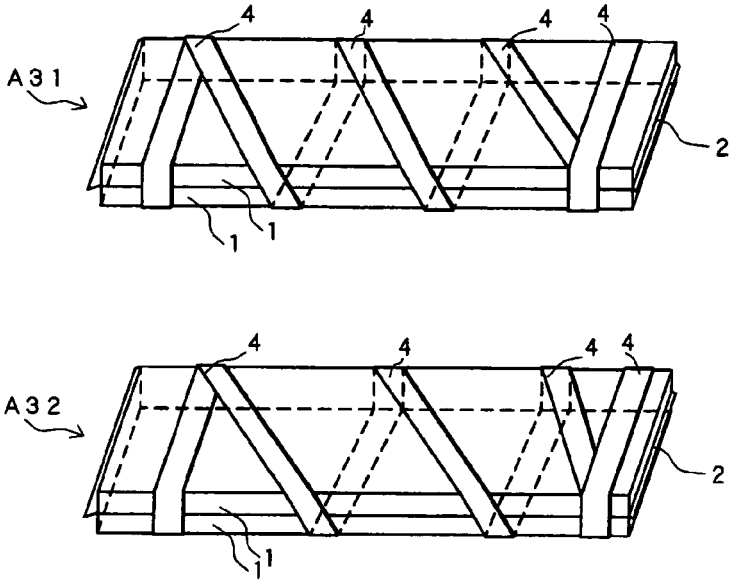
FIG. 3 is a view which shows a packaging structure for building boards and a building boards loading structure according to the third embodiment of the present invention.
Figure 3:
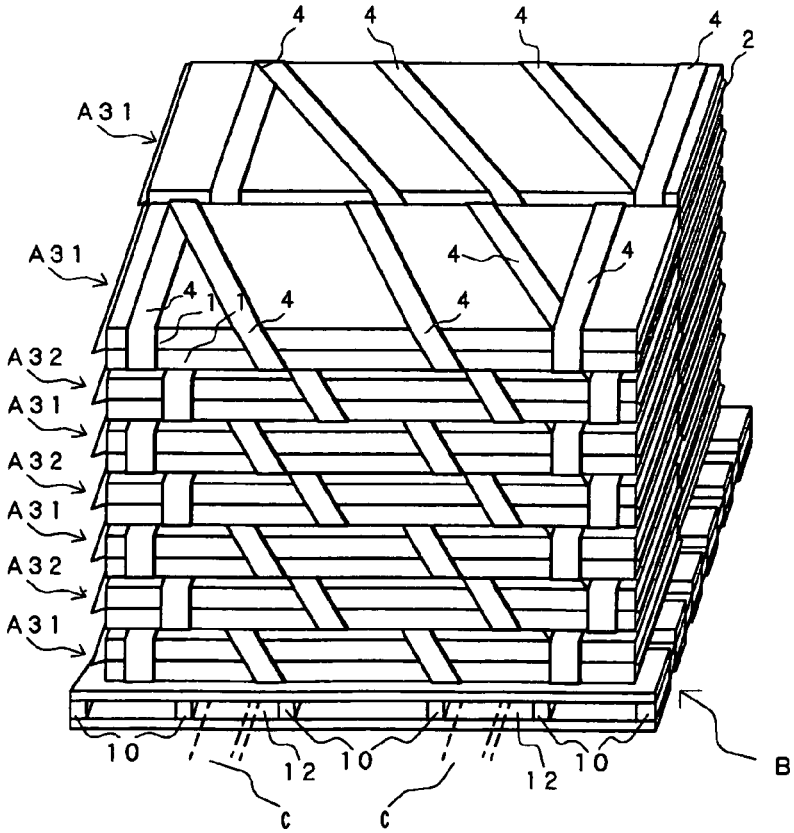

FIG. 3 is a view which shows a packaging structure for building boards and a building boards loading structure according to the third embodiment of the present invention. FIG. 3 (*a*) shows a perspective view of packages A31 and A32 of fiber reinforced cement sidings 1 as building boards, and FIG. 3 (*b*) shows a perspective view of a loading structure with loaded pallet B having packages A31 and A32.

Packages A31 and A32 are the same as packages A21 and A22 in having a structure in which two pieces of fiber reinforced cement siding 1 are banded by stretch film 4 and arranging in two lines. However, packages A31 and A32 are different from packages A21 and A22 in banding structure of stretch film 4. As shown in FIG. 3 (*a*), stretch film 4 bands plural fiber reinforced cement sidings 1 helically in packages A31 and A32, so that a banding force of the packages A31 and A32 by stretch film 4 becomes strong. And, even if force was added to the packages A31 and A32 from the outside, upper and lower fiber reinforced cement siding 1 slipping off in the package is controlled. In addition, packages A31 and A32 are different in a location of stretch film 4, so that the location of stretch film 4 in each upper and lower package which is loaded the pallet is different from each other by loading a package A31 with a package A32 alternately.

As shown in FIG. 3 (*b*), packages A31 and A32 are arranged in two lines, wherein packages A31 and A32 are loaded on pallet B alternately, so that a location of the stretch films 4 in each upper and lower package which is loaded on the pallet is different from each other. Therefore, it prevents a load from concentrating at the location of all the stretch films 4 and it does not make an unfavorable brightness and micro cracks at the surface of the fiber reinforced cement sidings 1. And, cutting the band and difficulty of picking up by sticking of a band to another band does not occur.

And, it is easy to pick up packages A31 and A32 from pallet B by catching the stretch film 4.

Furthermore, packages A31 and A32 are minimum packages, so that packaging cost is cheap, and productivity does not deteriorate. Unpacking at an installation site is only cutting the plural stretch films 4, and it is not necessary to transfer plural fiber reinforced cement sidings 1 to another pallet, and industrial waste after unpacking is little.

Embodiment 4

Figure 4:
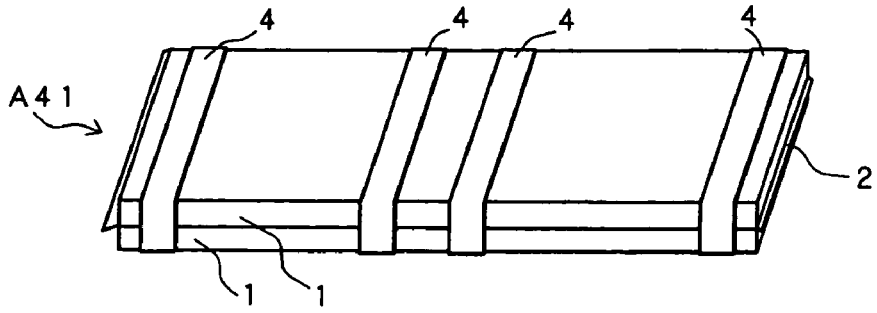
FIG. 4 is a view which shows a packaging structure for building boards and a building boards loading structure according to the fourth embodiment of the present invention.
Figure 4:
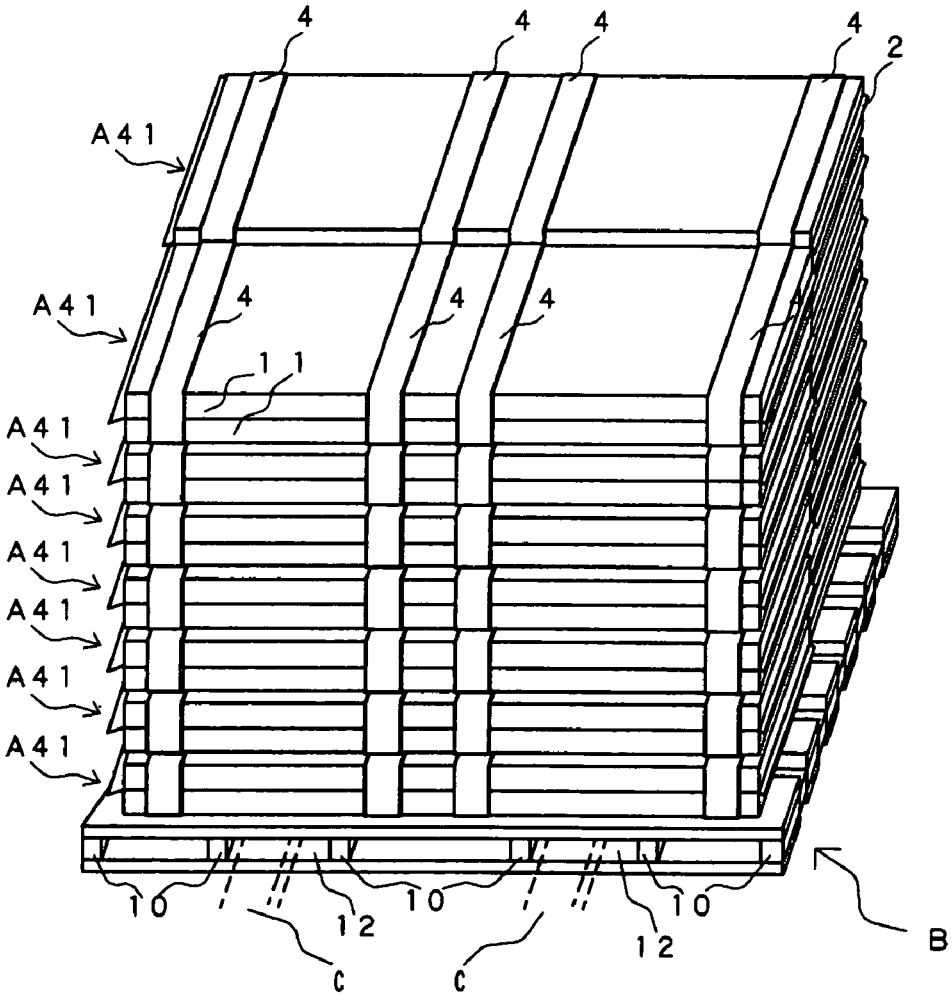

FIG. 4 is a view which shows a packaging structure for building boards and a building boards loading structure according to the fourth embodiment of the present invention. FIG. 4 (*a*) shows a perspective view of package A41 of fiber reinforced cement sidings 1 as building boards, and FIG. 4 (*b*) shows a perspective view of a loading structure with loaded pallet B having packages A41.

Package A41 is the same as packages A21 and A22 in having a structure in which two pieces of fiber reinforced cement siding 1 are banded by stretch film 4 and arranging in two lines. However, package A41 is different from packages A21 and A22 in a location of stretch films 4. As shown in FIG. 4 (*b*), a location of stretch films 4 in each upper and lower package A41 which is loaded on the pallet B is the same as each other. However, the location of stretch films 4 in the package A41 which is loaded on the pallet B is different from an upper location of the stringers 10 and an inserting fork C of a fork lift truck. Therefore, it prevents a load from concentrating at the location of the stretch films 4 and it does not make an unfavorable brightness and micro cracks at the surface of fiber reinforced cement sidings 1.

And, it is easy to pick up package A41 from pallet B by catching the stretch film 4.

Furthermore, package A41 is a minimum package, so that packaging cost is cheap, and productivity does not deteriorate. Unpacking at an installation site is only cutting the plural stretch films 4, and it is not necessary to transfer plural fiber reinforced cement sidings 1 to another pallet, and industrial waste after unpacking is little.

Embodiment 5

Figure 5:
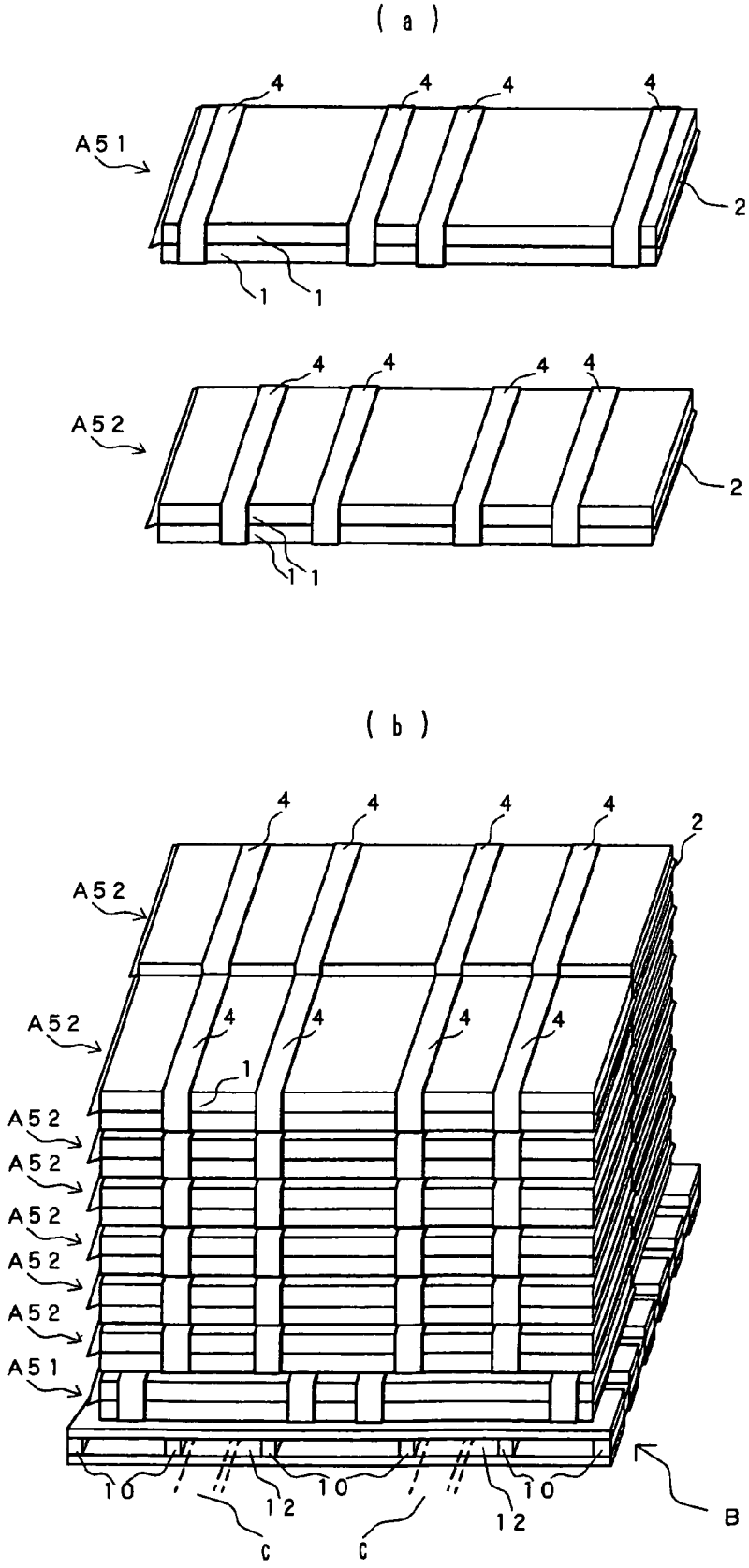
FIG. 5 is a view which shows a packaging structure for building boards and a building boards loading structure according to the fifth embodiment of the present invention.

FIG. 5 is a view which shows a packaging structure for building boards and a building boards loading structure according to the fifth embodiment of the present invention. FIG. 5 (*a*) shows a perspective view of packages A51 and A52 of fiber reinforced cement sidings 1 as building boards, and FIG. 5 (*b*) shows a perspective view of a loading structure with loaded pallet B having packages A51 and A52.

Packages A51 and A52 are the same as package A41 in having a structure in which two pieces of fiber reinforced cement siding 1 are banded by stretch film 4 and arranged in two lines. However, package A52 is different from package A41 in a location of stretch films 4.

As shown in FIG. 5 (*a*), packages A51 and A52 are different in a location of stretch films 4 to each other, and a location of stretch films 4 in package A51 which is loaded on the pallet B is different from an upper location of the stringers 10 and inserting fork C of a fork lift truck. As shown in FIG. 5 (*b*), a lowest package which is loaded on the pallet B is package A51, the others are packages A52. Therefore, a location of the stretch films 4 in a lowest package which is loaded on the pallet B is different from an upper location of the stringers 10 and inserting fork C of a fork lift truck, so that it prevents a load from concentrating at the location of all the stretch films 4 and it does not make an unfavorable brightness and micro cracks at the surface of the fiber reinforced cement sidings 1.

And, it is easy to pick up package A51 from pallet B by catching the stretch film 4.

Furthermore, package A51 is a minimum package, so that packaging cost is cheap, and productivity does not deteriorate. Unpacking at an installation site is only cutting the plural stretch films 4, and it is not necessary to transfer plural fiber reinforced cement sidings 1 to another pallet, and industrial waste after unpacking is little.

Embodiment 6

Figure 6:
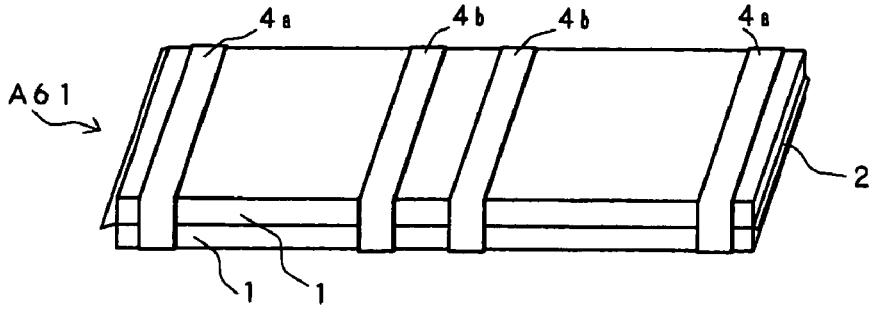
FIG. 6 is a view which shows a packaging structure for building boards and a building boards loading structure according to the sixth embodiment of the present invention.
Figure 6:
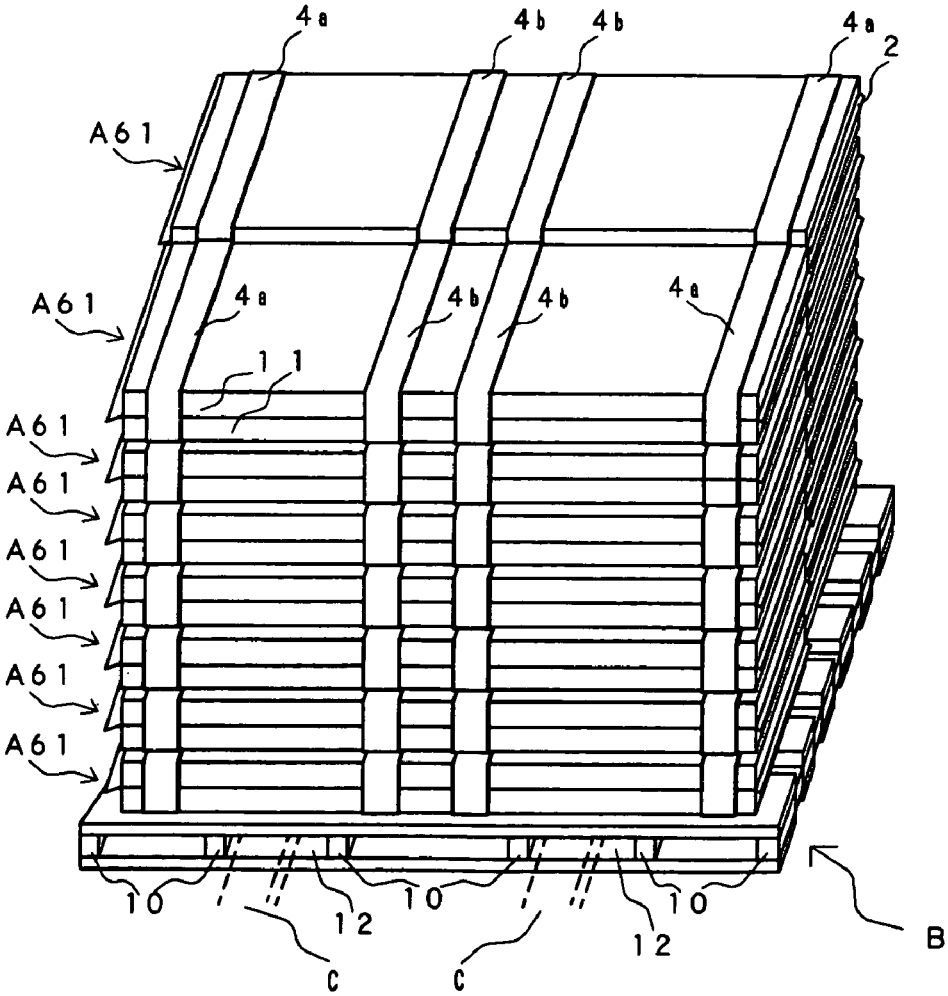

FIG. 6 is a view which shows a packaging structure for building boards and a building boards loading structure according to the sixth embodiment of the present invention. FIG. 6 (*a*) shows a perspective view of package A61 of fiber reinforced cement sidings 1 as building boards, and FIG. 6 (*b*) shows a perspective view of a loading structure with loaded pallet B having packages A61.

As shown in FIG. 6 (*a*), package A61 has a structure in which two pieces of fiber reinforced cement siding 1 are banded by stretch films 4*a* and stretch films 4*b*. In the packaging structure, a surface of stretch films 4*a* which are located at both ends of the packaging structure is adhesive, and a surface of stretch films 4*b* which are located in between both ends of the packaging structure is non-adhesive. A location of the stretch films 4*a* and stretch films 4*b* is the same in all packages A61.

As shown in FIG. 6 (*b*), the location of stretch films 4*a* and stretch films 4*b* in each upper and lower package A61 which is loaded on the pallet B is the same as each other. However, the location of stretch films 4*a* and stretch films 4*b* in the package A61 which is loaded on the pallet B is different from an upper location of the stringers 10 and the inserting fork C of a fork lift truck. Therefore, it prevents a load from concentrating at the location of all the stretch films 4*a* and stretch films 4*b* and it does not make an unfavorable brightness and micro cracks at the surface of the fiber reinforced cement sidings 1.

And, a surface of the stretch films 4*a* which are located at both ends of the package A61 which is loaded on the pallet B is adhesive, and the location of the stretch films 4*a* at both ends of the package in each upper and lower package which is loaded on the pallet B is the same, so that it is hard to collapse because of sticking of the packages A61.

And, it is easy to pick up package A61 from pallet B by catching the stretch film 4*a*.

Furthermore, package A61 is a minimum package, so that packaging cost is cheap, and productivity does not deteriorate. Unpacking at an installation site is only cutting the plural stretch films 4*a* and 4*b*, and it is not necessary to transfer plural fiber reinforced cement sidings 1 to another pallet, and industrial waste after unpacking is little.

Embodiment 7

Figure 7:
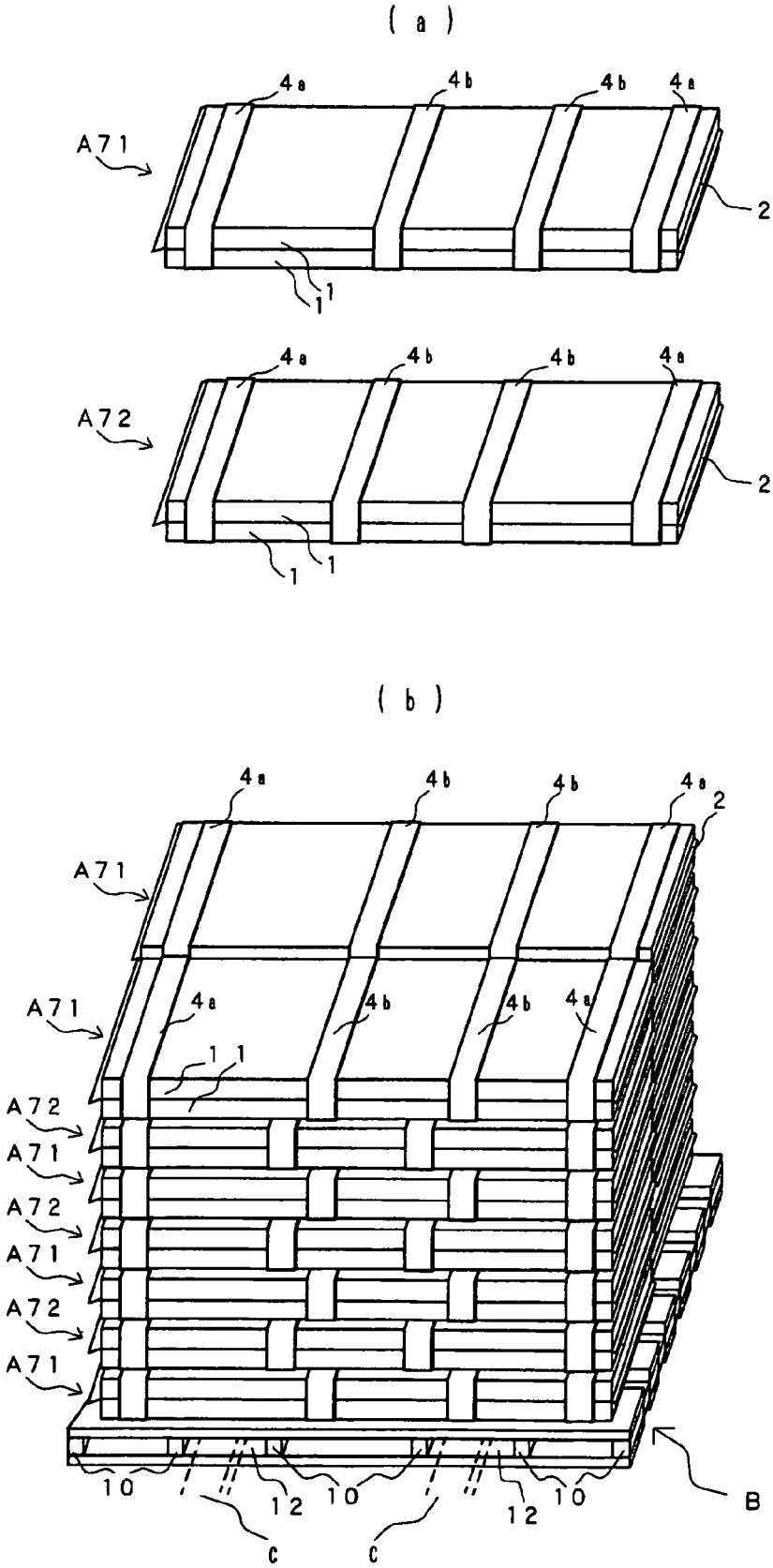
FIG. 7 is a view which shows a packaging structure for building boards and a building boards loading structure according to the seventh embodiment of the present invention.

FIG. 7 is a view which shows a packaging structure for building boards and a building boards loading structure according to the seventh embodiment of the present invention. FIG. 7 (*a*) shows a perspective view of packages A71 and A72 of fiber reinforced cement sidings 1 as building boards, and FIG. 7 (*b*) shows a perspective view of a loading structure with loaded pallet B having packages A71 and A72.

Packages A71 and A72 are the same as package A61 in having a structure in which two pieces of fiber reinforced cement siding 1 are banded by stretch films 4*a* and stretch films 4*b* and arranged in two lines. In the packaging structure, a surface of stretch films 4*a* which are located at both ends of the packaging structure is adhesive, and a surface of stretch films 4*b* which are located in between both ends of the packaging structure is non-adhesive. And, a location of stretch films 4*a* in packages A71 and A72 which are loaded on the pallet B is the same as each other, and it is different from an upper location of the stringers 10 and the inserting fork C of a fork lift truck.

However, packages A71 and A72 are different from package A61 in a location of stretch films 4*b*. As shown in FIG. 7 (*a*), packages A71 and A72 are different from a location of the stretch films 4*b* from each other, so that the location of stretch films 4*b* in each upper and lower package which is loaded on the pallet B is different from each other by loading a package A71 with a package A72 alternately.

As shown in FIG. 7 (*b*), packages A71 and A72 are loaded on pallet B alternately. A location of stretch films 4*a* in packages A71 and A72 which are loaded on the pallet B is the same as a location of the stretch films 4*a* as shown in FIG. 6(*b*), that is the location of stretch films 4*a* in packages A71 and A72 which are loaded on the pallet B is the same as each other, and it is different from an upper location of the stringers 10 and inserting fork C of a fork lift truck. However, a location of stretch films 4*b* in packages A71 and A72 which are loaded on the pallet B is different from a location of the stretch films 4*b* as shown in FIG. 6 (*b*). The packages A71 and A72 are loaded on pallet B alternately, so that a location of the stretch films 4*b* in between both ends of the package in each upper and lower package which is loaded on the pallet B is different from each other. Therefore, it prevents a load from concentrating at the location of all the stretch films 4*a* and 4*b*, and it does not make an unfavorable brightness and micro cracks at the surface of the fiber reinforced cement sidings 1. And, cutting the band and difficulty of picking caused by sticking of the band to another band does not occur.

And, a surface of stretch films 4*a* which is located at both ends of the packages A71 and A72 which is loaded on the pallet B is adhesive, and the location of the stretch films 4*a* at both ends of the package in each upper and lower package which is loaded on the pallet B is the same, so that it is hard to collapse because of sticking of the packages A71 and A72.

And, it is easy to pick up packages A71 and A72 from pallet B by catching the stretch film 4*a*.

Furthermore, packages A71 and A72 are a minimum package, so that packaging cost is cheap, and productivity does not deteriorate. Unpacking at an installation site is only cutting the plural stretch films 4*a* and 4*b*, and it is not necessary to transfer plural fiber reinforced cement sidings 1 to another pallet, and industrial waste after unpacking is little.

Embodiment 8

Figure 8:
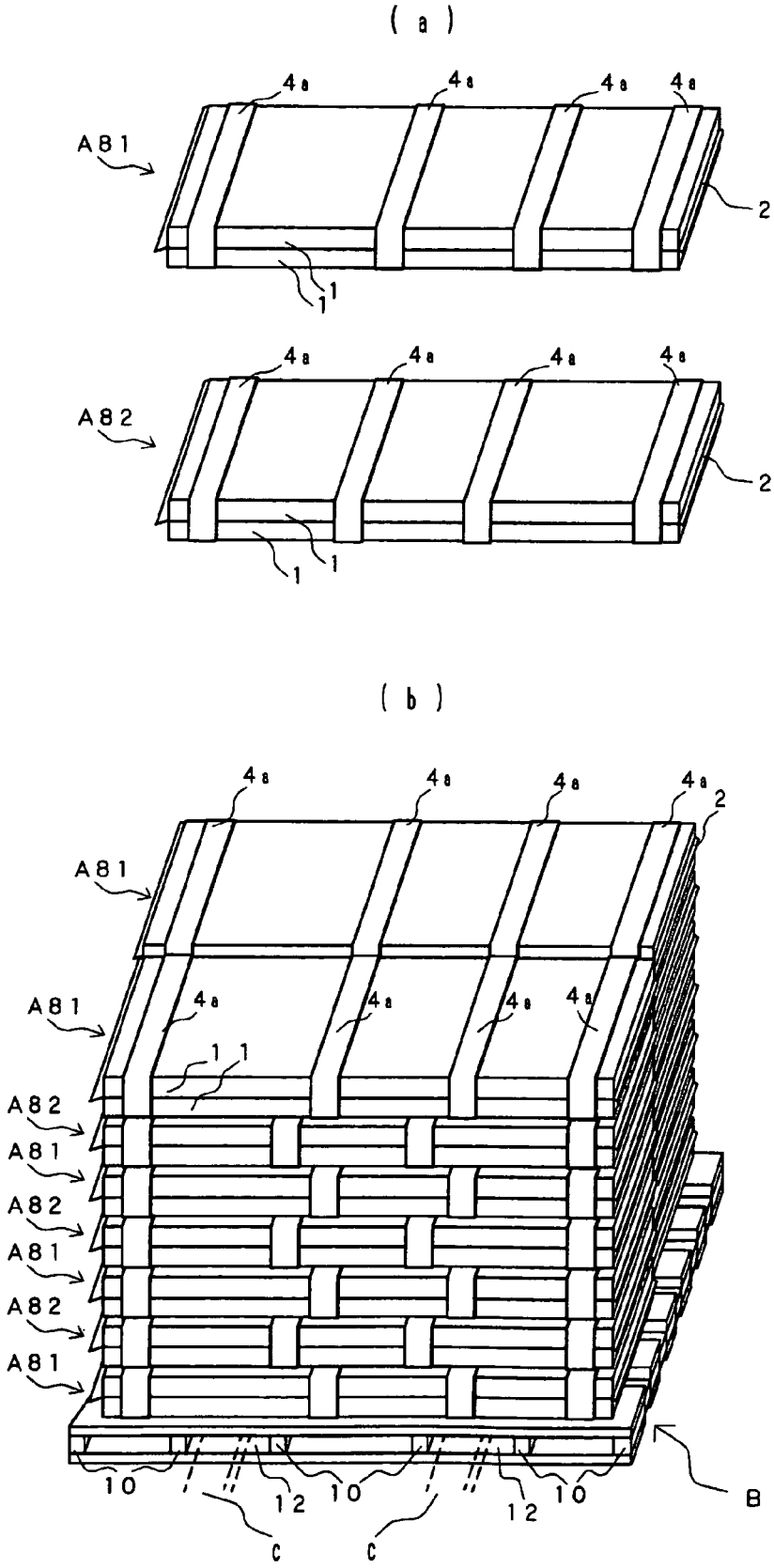
FIG. 8 is a view which shows a packaging structure for building boards and a building boards loading structure according to the eighth embodiment of the present invention.

FIG. 8 is a view which shows a packaging structure for building boards and a building boards loading structure according to the eighth embodiment of the present invention. FIG. 8 (*a*) shows a perspective view of packages A81 and A82 of fiber reinforced cement sidings 1 as building boards, and FIG. 8 (*b*) shows a perspective view of a loading structure with loaded pallet B having packages A81 and A82.

Packages A81 and A82 are the same as packages A71 and A72 except that all the band are stretch films 4*a*.

As shown in FIG. 8 (*b*), a location of the stretch films 4*a* in between both ends of the package in each upper and lower package which is loaded on the pallet B is different from each other by loading a package A81 with a package A82 alternately. Therefore, it prevents a load from concentrating at the location of all the stretch films 4*a*, and it does not make an unfavorable brightness and micro cracks at the surface of the fiber reinforced cement sidings 1. And, cutting the band and difficulty of picking up by sticking of the bands to another band does not occur.

And, a surface of the stretch films 4*a* which are located at both ends of the packages A81 and A82 which is loaded on the pallet B is adhesive, and the location of the stretch films 4*a* at both ends of the package in each upper and lower package which is loaded on the pallet B is the same, so that it is hard to collapse because of sticking the packages A81 and A82.

And, it is easy to pick up packages A81 and A82 from pallet B by catching the stretch film 4*a*.

Furthermore, packages A81 and A82 are a minimum package, so that packaging cost is cheap, and productivity does not deteriorate. Unpacking at an installation site is only cutting the plural stretch films 4*a*, and it is not necessary to transfer plural fiber reinforced cement sidings 1 to another pallet, and industrial waste after unpacking is little.

Embodiment 9

Figure 9:
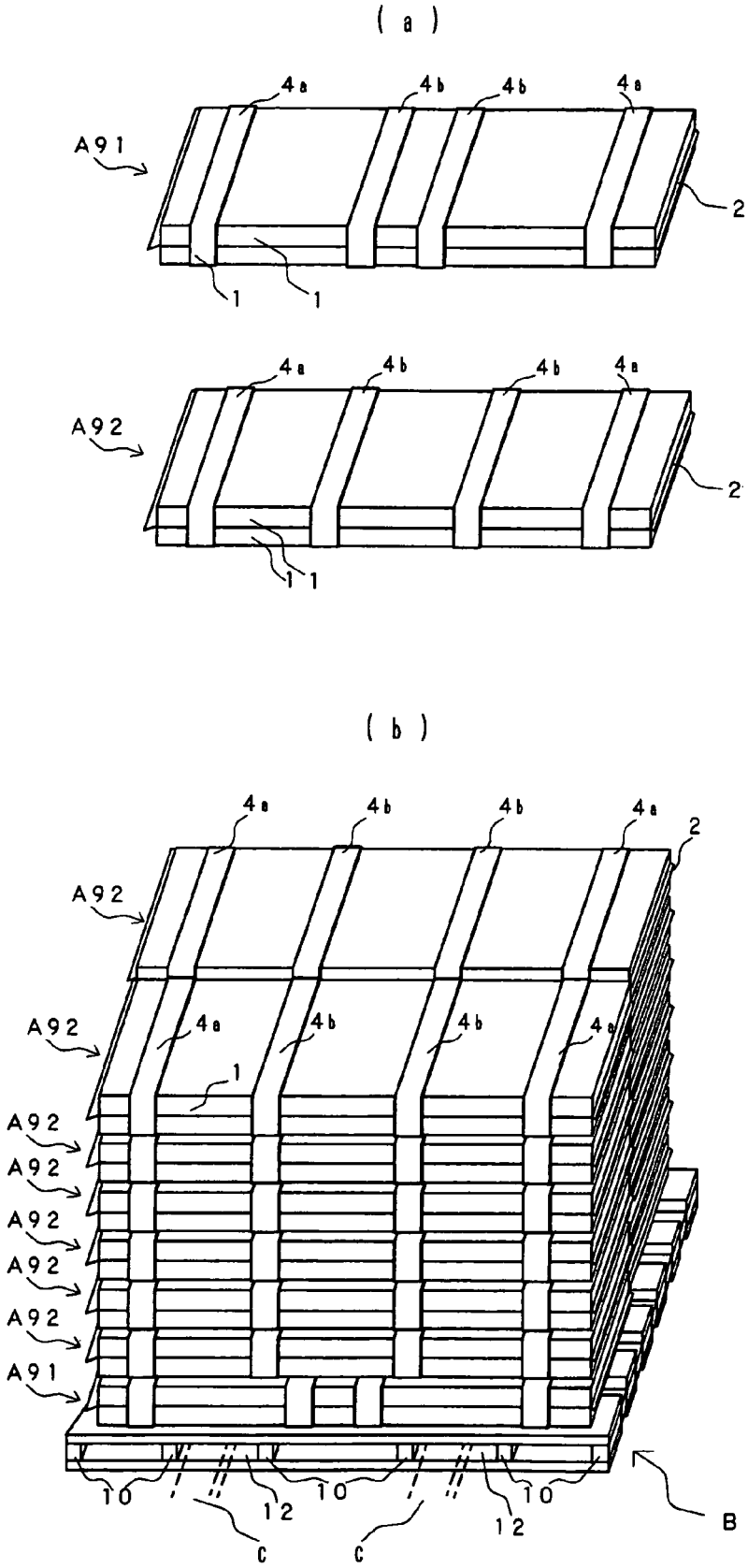
FIG. 9 is a view which shows a packaging structure for building boards and a building boards loading structure according to the ninth embodiment of the present invention.

FIG. 9 is a view which shows a packaging structure for building boards and a building boards loading structure according to the ninth embodiment of the present invention. FIG. 9 (*a*) shows a perspective view of packages A91 and A92 of fiber reinforced cement sidings 1 as building boards, and FIG. 9 (*b*) shows a perspective view of a loading structure with loaded pallet B having packages A91 and A92.

Packages A91 and A92 are the same as package A61 in having a structure in which two pieces of fiber reinforced cement siding 1 are banded by stretch films 4*a* and 4*b* and arranged in two lines. In the packaging structure, a surface of stretch films 4*a* which are located at both ends of the packaging structure is adhesive, and a surface of stretch films 4*b* which are located in between both ends of the packaging structure is non-adhesive. And, a location of stretch films 4*a* in packages A91 and A92 which are loaded on the pallet B is the same as each other, and it is different from an upper location of the stringers 10 and inserting fork C of a fork lift truck. And, a location of stretch films 4*b* in package A91 which is loaded on the pallet B is the same as package A61, and it is different from an upper location of the stringers 10 and inserting fork C of a fork lift truck. However, a location of stretch films 4*b* in package A92 is different from package A61. As shown in FIG. 9 (*a*), packages A91 and A92 are different from a location of stretch films 4*b* to each other, and a location of stretch films 4*b* in package A91 which is loaded on the pallet B is different from an upper location of the stringers 10 and inserting fork C of a fork lift truck, so that the location of stretch films 4*b* in each upper and lower package which is loaded on the pallet B is different from each other by loading a package A91 with a package A92.

As shown in FIG. 9(*b*), a lowest package which is loaded on the pallet B is package A91, another is package A92. Therefore, a location of stretch films 4*a* and 4*b* in a lowest package which is loaded on the pallet B is different from upper location of the stringers 10 and inserting fork C of a fork lift truck, so that it prevents a load from concentrating at the location of all stretch films 4*a* and 4*b* and it does not make an unfavorable brightness and micro cracks at the surface of the fiber reinforced cement sidings 1.

And, a surface of the stretch films 4*a* which are located at both ends of the packages A91 and A92 which are loaded on the pallet B is adhesive, and the location of the stretch films 4*a* at both ends of the package in each upper and lower package which is loaded on the pallet B is the same, so that it is hard to collapse because of sticking of the packages A91 and A92.

And it is easy to pick up packages A91 and A92 from the pallet B by catching the stretch film 4*a*.

Furthermore, packages A91 and A92 are a minimum package, so that packaging cost is cheap, and productivity does not deteriorate. Unpacking at an installation site is only cutting the plural stretch films 4*a* and 4*b*, and it is not necessary to transfer plural fiber reinforced cement sidings 1 to another pallet, and industrial waste after unpacking is little.

Embodiment 10

Figure 10:
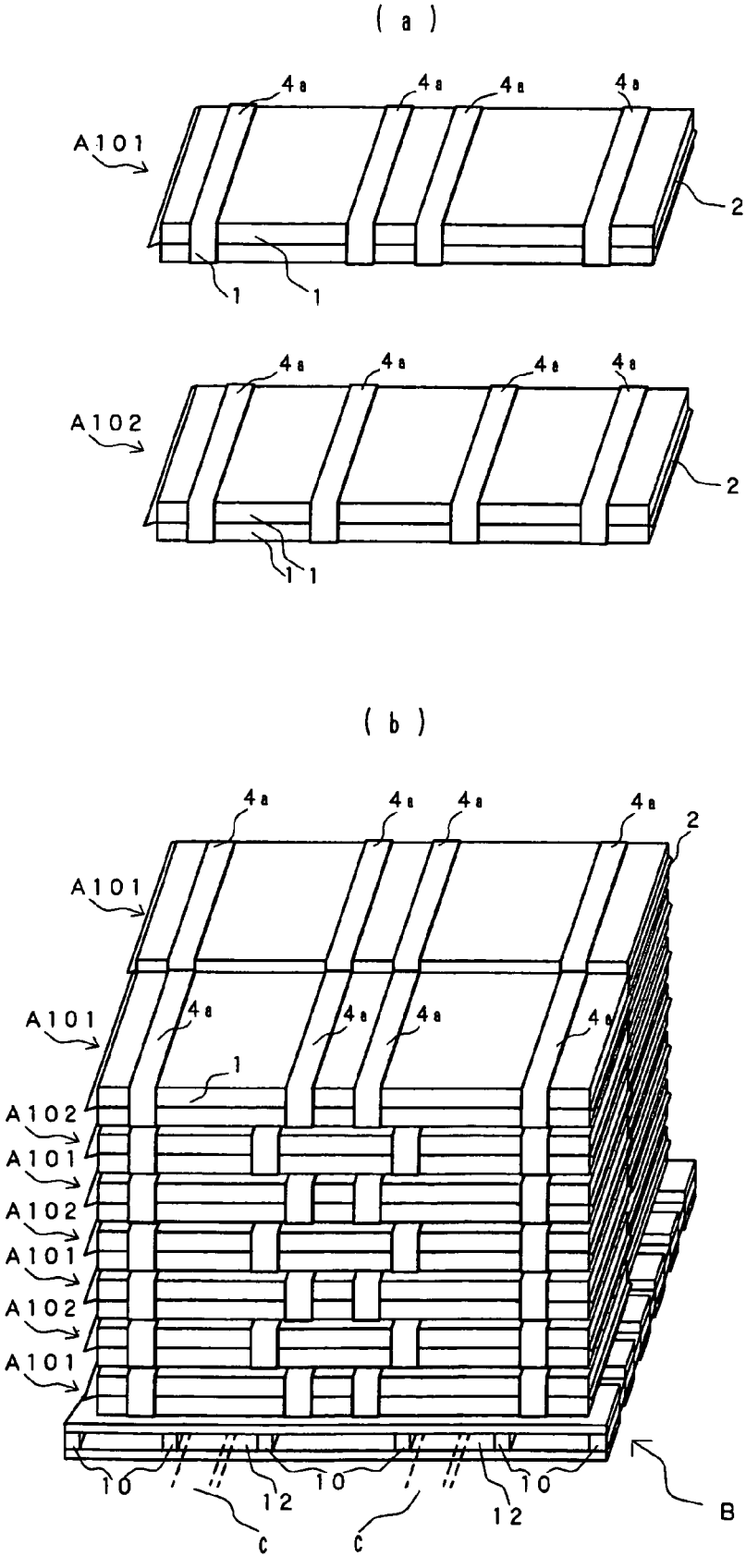
FIG. 10 is a view which shows a packaging structure for building boards and a building boards loading structure according to the tenth embodiment of the present invention.

FIG. 10 is a view which shows a packaging structure for building boards and a building boards loading structure according to the tenth embodiment of the present invention. FIG. 10 (*a*) shows a perspective view of packages A101 and A102 of fiber reinforced cement sidings 1 as building boards, and FIG. 10 (*b*) shows a perspective view of loading structure with loaded pallet B having packages A101 and A102.

Packages A101 and A102 are the same as packages A81 and A82 except for a location of stretch films 4*a* in between both ends of the package.

As shown in FIG. 10 (*a*), a location of the stretch films 4*a* in between both ends of the package A101 are different from a location of the stretch films 4*a* in between both ends of the package A102, and a location of stretch films 4*a* in between both ends of the package A101 which is loaded on the pallet B is different from an upper location of the stringers 10 and inserting fork C of a fork lift truck, so that the location of the stretch films 4*a* in between both ends of each upper and lower package which is loaded on the pallet B is different from each other by loading a package A101 with a package A102.

As shown in FIG. 10 (*b*), a location of the stretch films 4*a* in between both ends of the package in each upper and lower package which is loaded on the pallet B is different from each other by loading a package A101 with a package A102 alternately. Therefore, it prevents a load from concentrating at the location of all the stretch films 4*a*, and it does not make an unfavorable brightness and micro cracks at the surface of the fiber reinforced cement sidings 1. And, cutting the band and difficulty of picking up by sticking of the band to another band does not occur.

And, a surface of the stretch films 4*a* which are located at both ends of the packages A101 and A102 which are loaded on the pallet B is adhesive, and the location of the stretch films 4*a* at both ends of the package in each upper and lower package which is loaded on the pallet B is the same, so that it is hard to collapse because of sticking of the packages A101 and A102.

And, it is easy to pick up packages A101 and A102 from pallet B by catching the stretch film 4*a*.

Furthermore, packages A101 and A102 are a minimum package, so that packaging cost is cheap, and productivity does not deteriorate. Unpacking at an installation site is only cutting the plural stretch films 4*a*, and it is not necessary to transfer plural fiber reinforced cement sidings 1 to another pallet, and industrial waste after unpacking is little.

Embodiment 11

Figure 11:
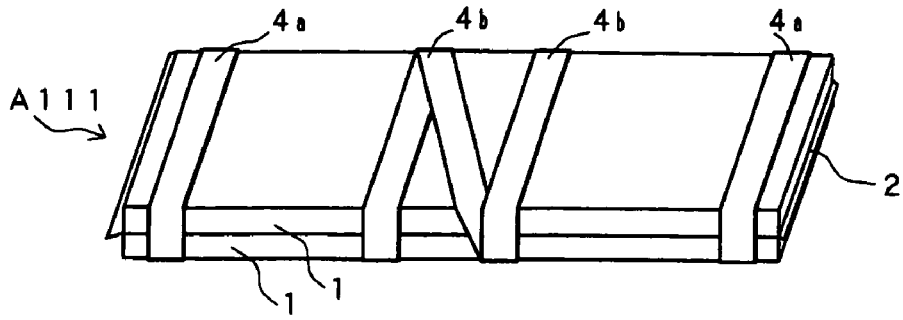
FIG. 11 is a view which shows a packaging structure for building boards and a building boards loading structure according to the eleventh embodiment of the present invention.
Figure 11:
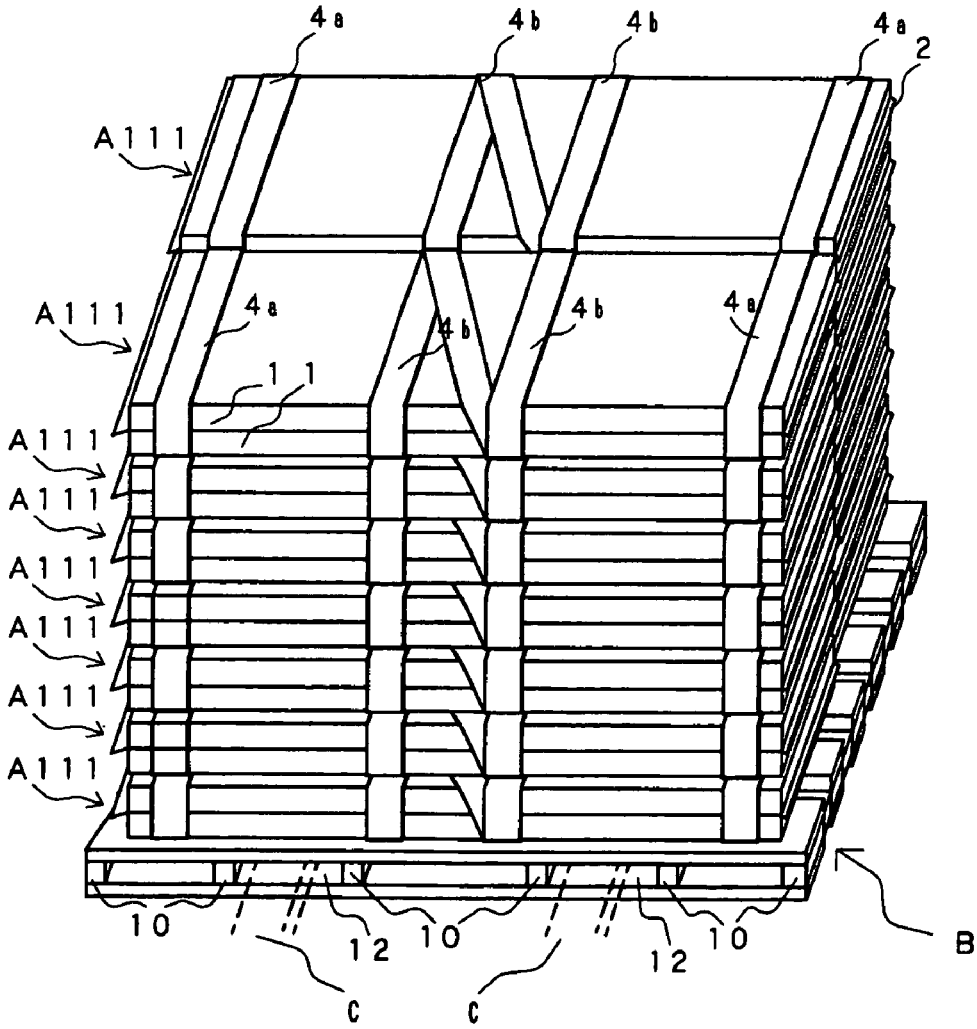

FIG. 11 is a view which shows a packaging structure for building boards and a building boards loading structure according to the eleventh embodiment of the present invention. FIG. 11 (*a*) shows a perspective view of packages A111 of fiber reinforced cement sidings 1 as building boards, and FIG. 11 (*b*) shows a perspective view of a loading structure with loaded pallet B having packages A111.

Package A111 is the same as package A61 in having a structure with two pieces of fiber reinforced cement siding 1 banded by stretch films 4*a* and stretch films 4*b* and arranged in two lines. In the packaging structure, a surface of the stretch films 4*a* which are located at both ends of the packaging structure is adhesive, and a surface of the stretch films 4*b* which are located in between both ends of the packaging structure is non-adhesive. And, a location of the stretch films 4*a* in package A111 which are loaded on the pallet B is different from an upper location of the stringers 10 and inserting fork C of a fork lift truck.

However, package A111 is different from package A61 in banding structure of the stretch film 4*b*. As shown in FIG. 11 (*a*), stretch film 4*b* bands plural fiber reinforced cement sidings 1 helically in package A111, so that a banding force of the package A111 by stretch film 4*b* becomes strong. And, even if a force was added to the package A111 from the outside, upper and lower fiber reinforced cement siding 1 slipping off in the package is controlled.

In addition, a location of stretch films 4*a* and 4*b* in package A111 which is loaded on the pallet B is different from an upper location of the stringers 10 and inserting fork C of a fork lift truck, so that it prevents a load from concentrating at the location of all the stretch films 4*a* and 4*b* and it does not make an unfavorable brightness and micro cracks at the surface of the fiber reinforced cement sidings 1.

And, a surface of the stretch films 4*a* which are located at both ends of the package A111 which is loaded on the pallet B is adhesive, and the location of the stretch films 4*a* at both ends of the package in each upper and lower package which is loaded on the pallet B is the same, so that it is hard to collapse because of sticking of the packages A111.

And, it is easy to pick up package A111 from pallet B by catching the stretch film 4*a*.

Furthermore, package A111 is a minimum package, so that packaging cost is cheap, and productivity does not deteriorate. Unpacking at an installation site is only cutting the plural stretch films 4*a* and 4*b*, and it is not necessary to transfer plural fiber reinforced cement sidings 1 to another pallet, and industrial waste after unpacking is little.

Embodiment 12

Figure 12:
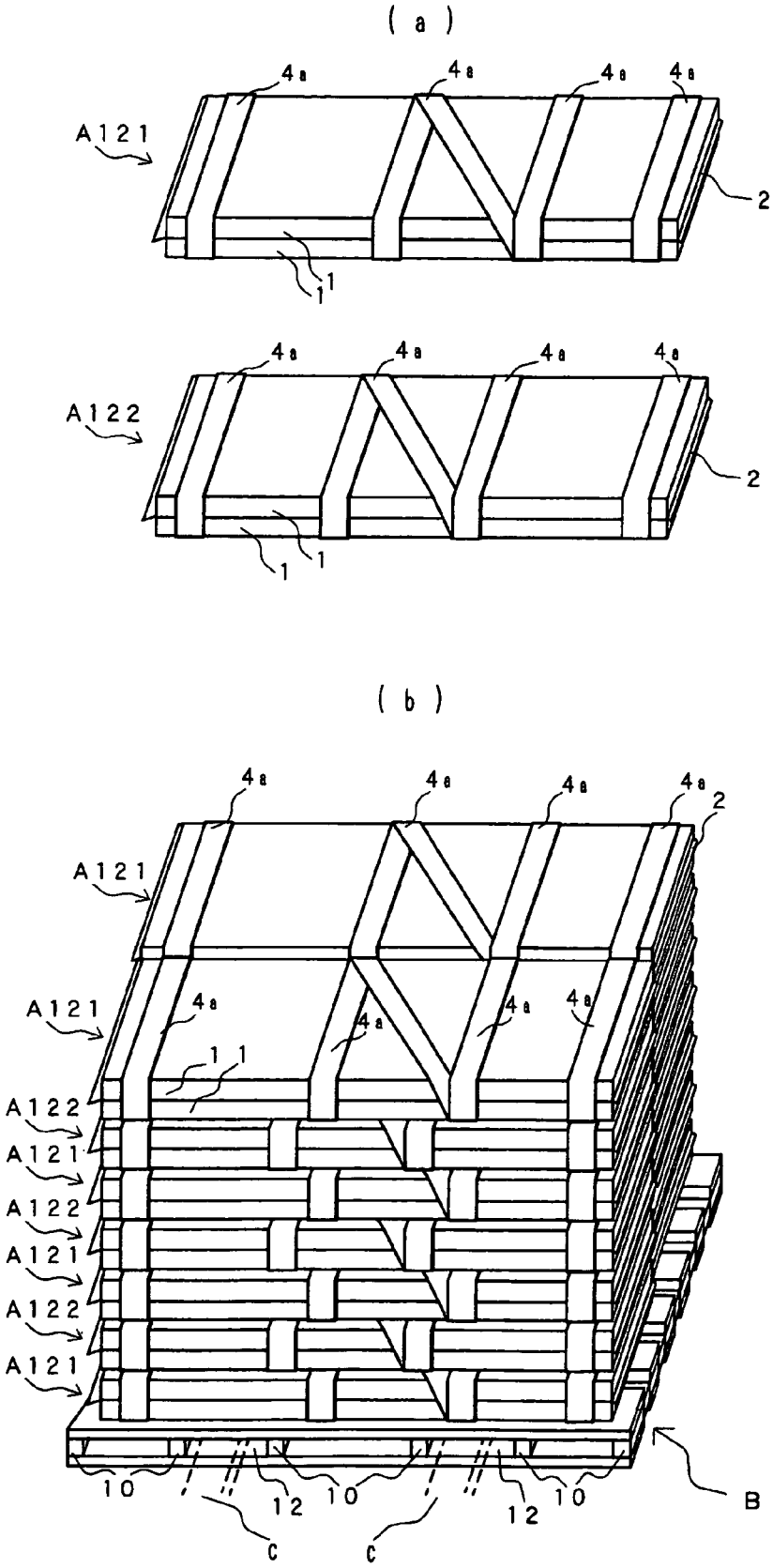
FIG. 12 is a view which shows a packaging structure for building boards and a building boards loading structure according to the twelfth embodiment of the present invention.

FIG. 12 is a view which shows a packaging structure for building boards and a building boards loading structure according to the twelfth embodiment of the present invention. FIG. 12 (*a*) shows a perspective view of packages A121 and A122 of fiber reinforced cement sidings 1 as building boards, and FIG. 12 (*b*) shows a perspective view of loading structure with loaded pallet B having packages A121 and A122.

Packages A121 and A122 are the same as package A111 in having a structure with two pieces of fiber reinforced cement siding 1 banded by stretch films 4*a* and arranged in two lines. In the packaging structure, a surface of stretch films 4*a* is adhesive. And a location of the stretch films 4*a* which are located at both ends of packages A121 and A122 which are loaded on the pallet B is different from an upper location of the stringers 10 and inserting fork C of a fork lift truck.

However, stretch film which is located in between both ends of packages A121 and A122 is different from package A111. As shown in FIG. 12 (*a*), the stretch film which is located between both ends of packages A121 and A122 is stretch film 4*a* having an adhesive surface, and a location of stretch films 4*a* which are located in between both ends of package A121 is different from package A122. As shown in FIG. 12 (*b*), a location of stretch films 4*a* in between both ends of the package in each upper and lower package which is loaded on the pallet B is different from each other by loading a package A121 with a package A122 alternately. Therefore, it prevents a load from concentrating at the location of all the stretch films 4*a*, and it does not make an unfavorable brightness and micro cracks at the surface of the fiber reinforced cement sidings 1. And, cutting the band and a difficulty of picking up by sticking the band to another band does not occur.

And, a surface of stretch films 4*a* which is located at both ends of the packages A121 and A122 which are loaded on the pallet B is adhesive, and the location of the stretch films 4*a* at both ends of the package in each upper and lower package which is loaded on the pallet B is the same, so that it is hard to collapse because of sticking of the packages A121 and A122.

And, it is easy to pick up packages A121 and A122 from pallet B by catching the stretch film 4*a*.

Furthermore, packages A121 and A122 are a minimum package, so that packaging cost is cheap, and productivity does not deteriorate. Unpacking at an installation site is only cutting the plural stretch films 4*a*, and it is not necessary to transfer plural fiber reinforced cement sidings 1 to another pallet, and industrial waste after unpacking is little.

Embodiment 13

Figure 13:
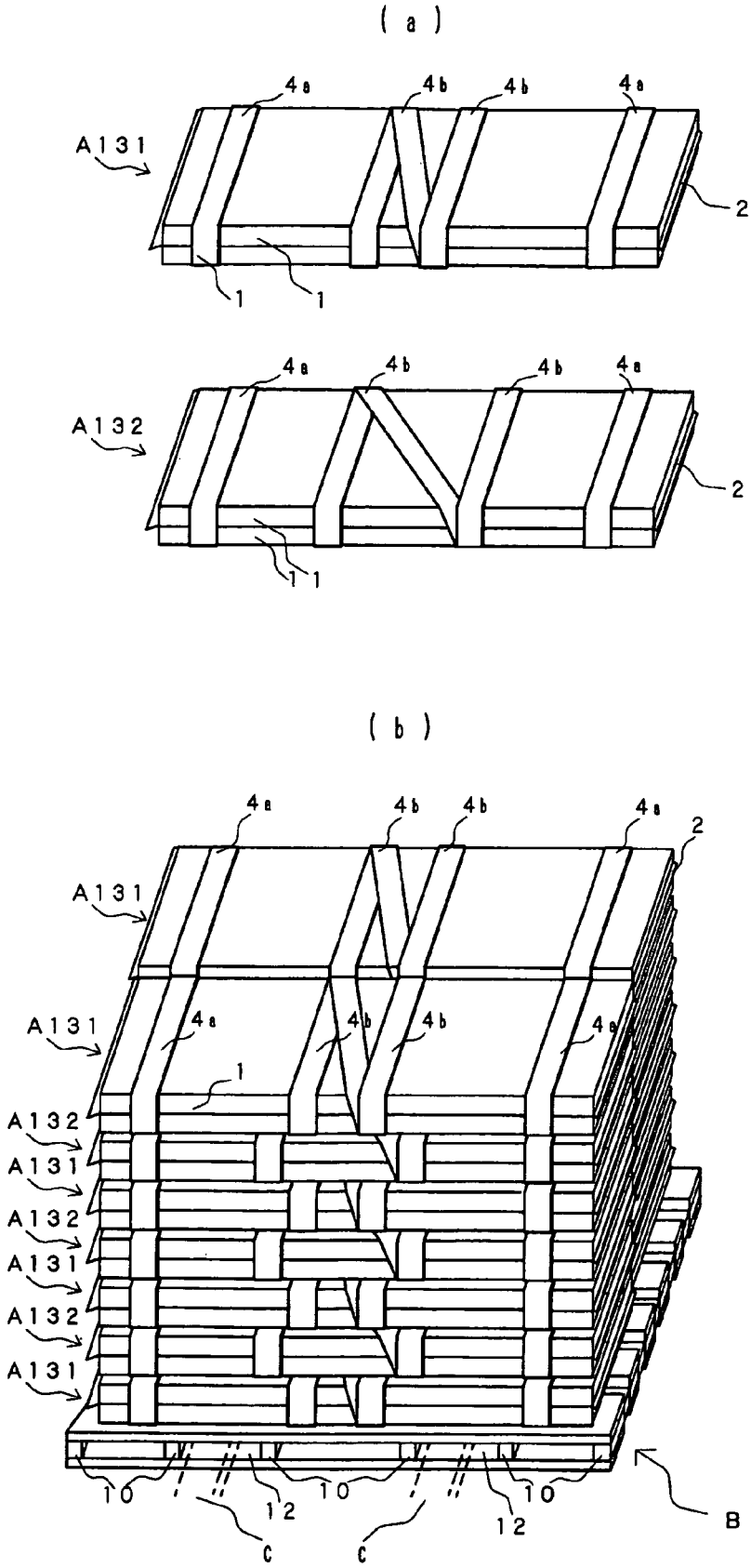
FIG. 13 is a view which shows a packaging structure for building boards and a building boards loading structure according to the thirteenth embodiment of the present invention.
Figure 14:
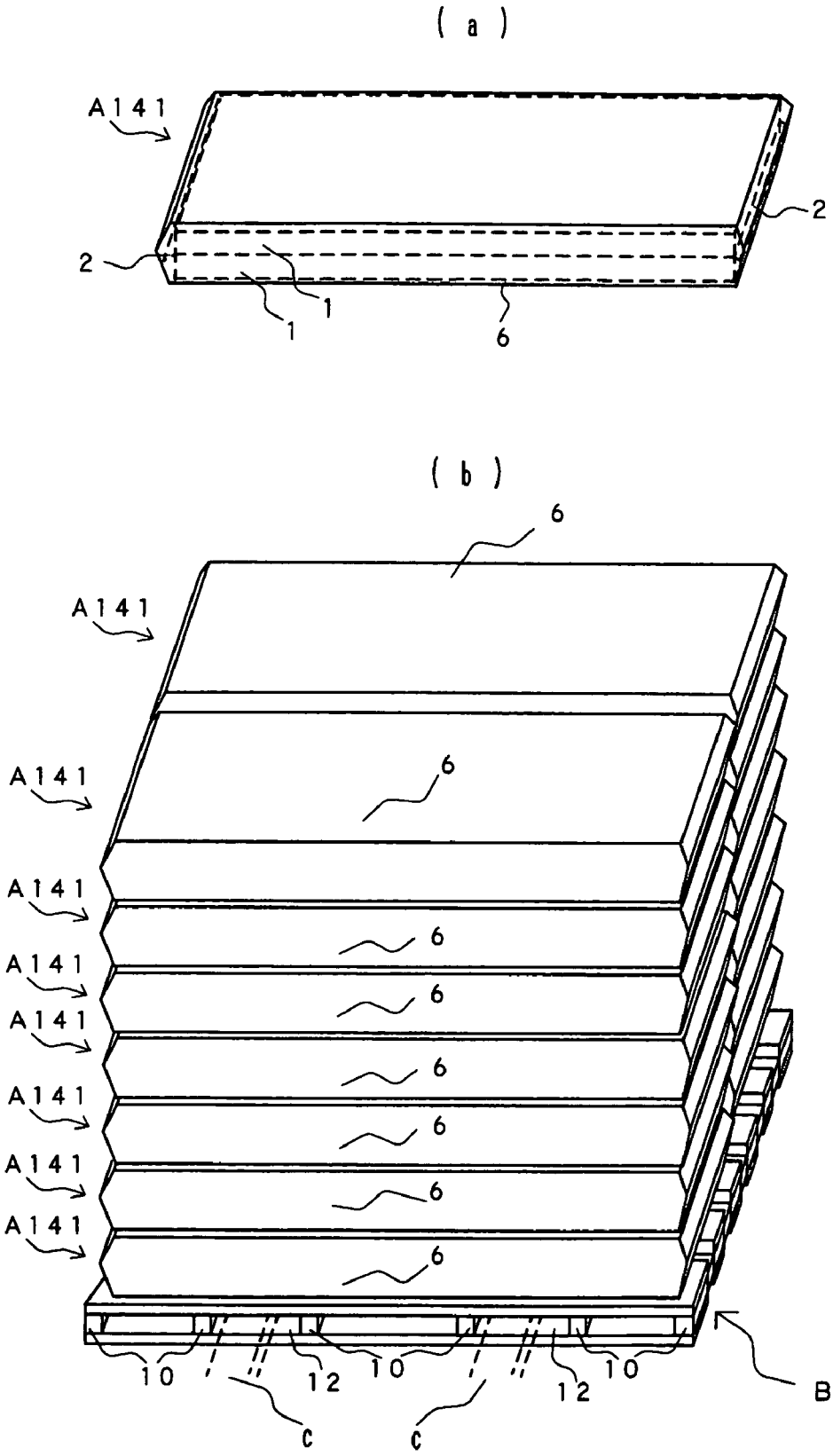
FIG. 14 is a view which shows a packaging structure for building boards and a building boards loading structure according to a related art.
Figure 15:
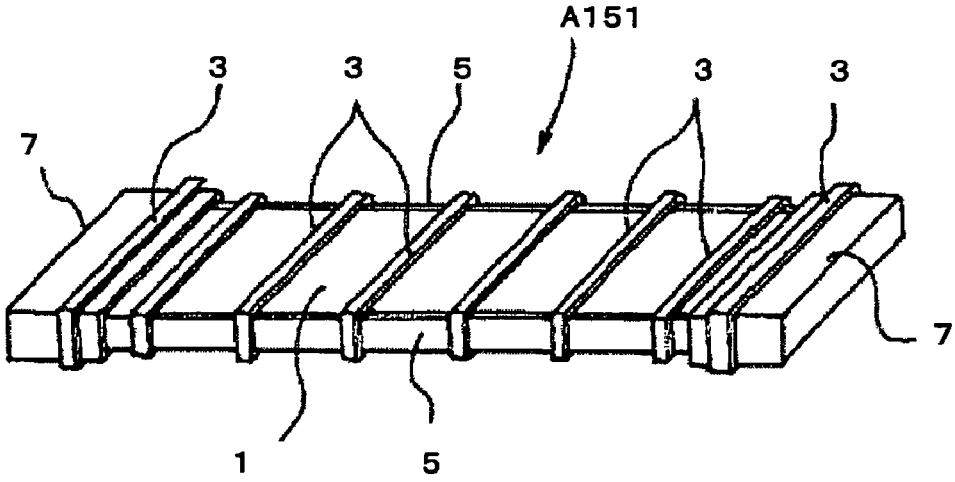
FIG. 15 is a view which shows a packaging structure for building boards and a building boards loading structure according to other related art.
Figure 15:
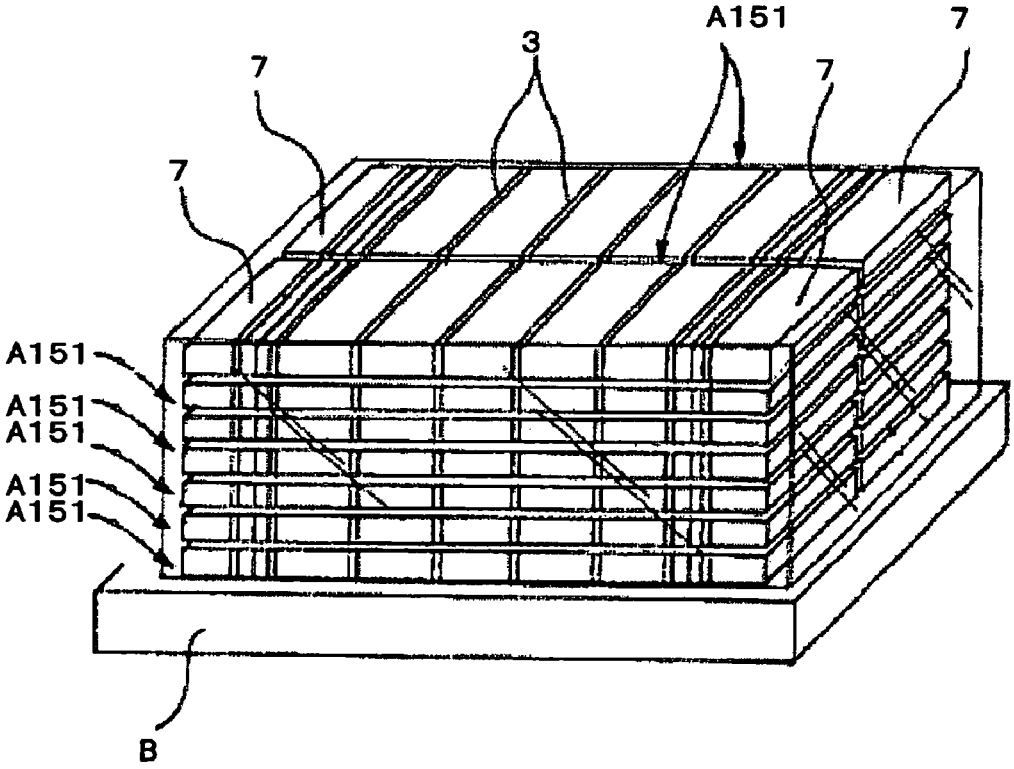
Figure 16:
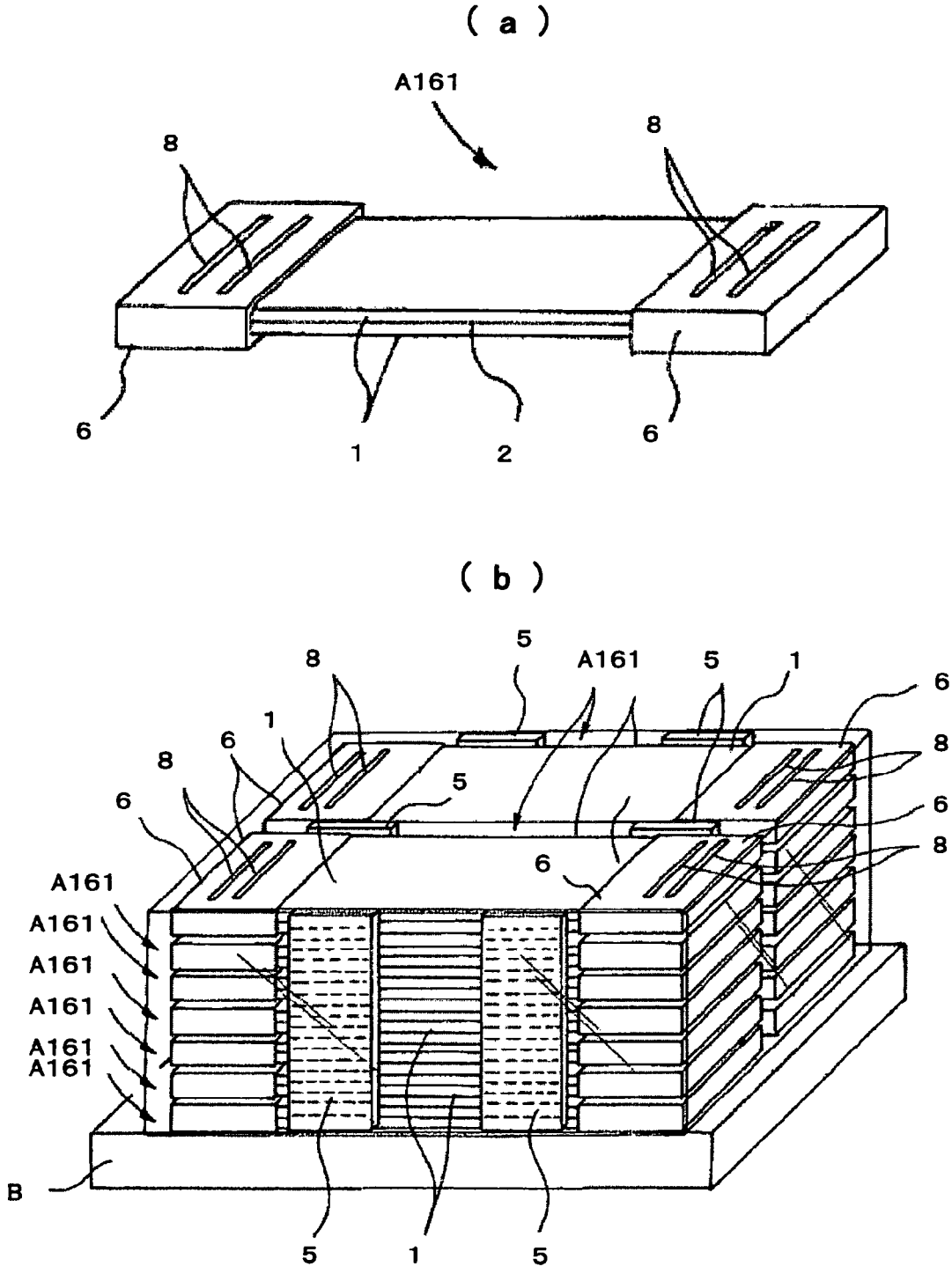
FIG. 16 is a view which shows a packaging structure for building boards and a building boards loading structure according to other related art.
Figure 17:
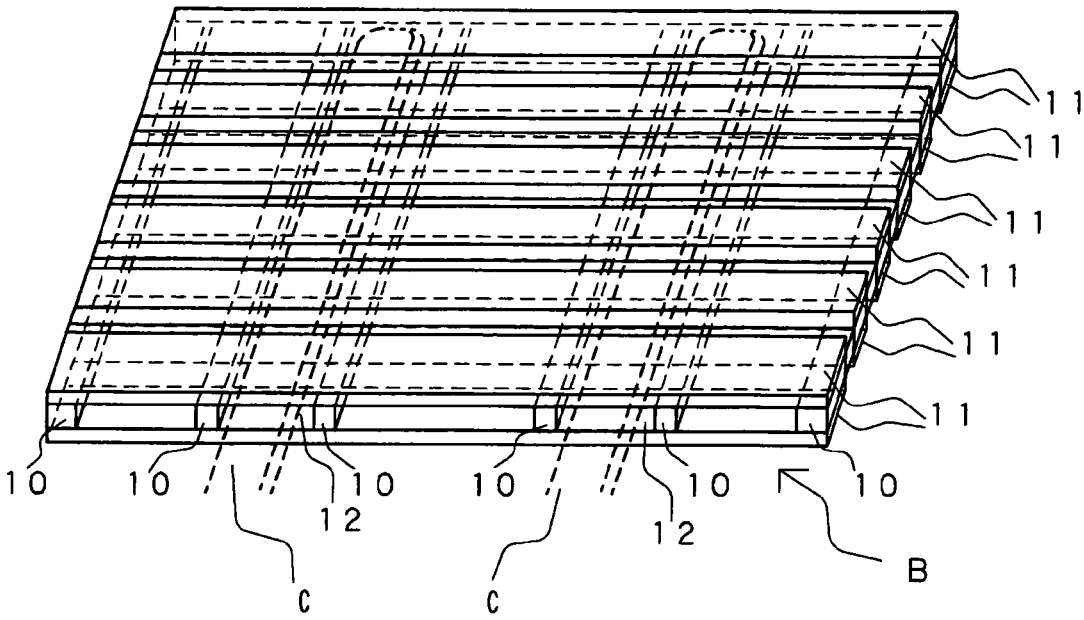
FIG. 17 is a view which shows a pallet to load with building boards.

FIG. 13 is a view which shows a packaging structure for building boards and a building boards loading structure according to the thirteenth embodiment of the present invention. FIG. 13 (*a*) shows a perspective view of packages A131 and A132 of fiber reinforced cement sidings 1 as building boards, and FIG. 13 (*b*) shows a perspective view of a loading structure on loaded pallet B having packages A131 and A132.

Packages A131 and A132 are the same as packages A121 and A122 except stretch films are between both ends of the package.

As shown in FIG. 13 (*a*), the stretch film which is located between both ends of packages A131 and A132 is stretch film 4*b* having a non-adhesive surface, and a location of the stretch film 4*b* which is located between both ends of package A131 is different from package A132, and a location of the stretch films 4*b* in between both ends of the package A131 which is loaded on the pallet B is different from an upper location of the stringers 10 and inserting fork C of a fork lift truck.

As shown in FIG. 13 (*b*), a lowest package which is loaded on the pallet B is package A131, a location of the stretch films 4*b* is in between both ends of the package in each upper and lower package which is loaded on the pallet B is different from each other by loading a package A131 with a package A132 alternately. Therefore, it prevents a load from concentrating at the location of all the stretch films 4*a* and 4*b*, and it does not make an unfavorable brightness and micro cracks at the surface of the fiber reinforced cement sidings 1. And, cutting the band and difficulty of picking up by sticking of the band to another band does not occur.

And, a surface of the stretch films 4*a* which is located at both ends of the packages A131 and A132 which is loaded on the pallet B is adhesive, and the location of the stretch films 4*a* at both ends of the package in each upper and lower package which is loaded on the pallet B is the same, so that it is hard to collapse because of sticking of the packages A131 and A132.

And it is easy to pick up packages A131 and A132 from pallet B by catching the stretch film 4*a*.

Furthermore, packages A131 and A132 are a minimum package, so that packaging cost is cheap, and productivity does not deteriorate. Unpacking at an installation site is only cutting the plural stretch films 4*a* and 4*b*, and it is not necessary to transfer plural fiber reinforced cement sidings 1 to another pallet, and industrial waste after unpacking is little.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

For example, a number, a location, a quality, a material, shape of banding, dimension, form of bands of package can be changed for achieving the present invention. In addition, a package can have a structure in which two pieces of building board are piled up with attaching cushioning materials on either side of a longer direction of two pieces of building board, and/or building boards loading structure can have cushioning materials on either side of a longer direction of packages which are loaded on a pallet. Furthermore, a pallet which does not comprise deck board 11 in an undersurface of a stringer can be used.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. In this disclosure and during the prosecution of this application, the terminology "present invention" or "invention" is meant as a non-specific, general reference and may be used as a reference to one or more aspect within the present disclosure. The language present invention or invention should not be improperly interpreted as an identification of criticality, should not be improperly interpreted as applying across all aspects or embodiments (i.e. it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features.

What is claimed is:

1. A building boards loading structure which loads plural building boards, the building boards being similar sheets having the same dimensions, on a pallet, wherein the building boards loading structure comprises two kinds of packages, each package has a structure in which the plural building boards are banded at plural locations by bands the two kinds of packages are different regarding the locations of the bands, the pallet comprises plural stringers arranged by predetermined spacing and plural deck boards fixed on a top surface of the stringers, a length of each deck board in a length direction is longer than a length of either of the two kinds of packages in a length direction, a length of each stringer in a length direction is longer than the width of either of the two kinds of packages in a width direction, the plural stringers and plural deck boards form plural entries to insert a fork lift truck, a plurality of the two kinds of packages are arranged on the pallet with the length direction of the two kinds of packages being parallel to the length direction of the deck boards, the plurality of the two kinds of packages are loaded on the pallet in a vertically stacked manner with edges of the plurality of the two kinds of packages being even with each other to provide an upper and lower package, in considering any vertically adjacent two packages of the plurality of the two kinds of packages, locations of the bands in each upper and lower package which is loaded on the pallet are different from each other by loading the two kinds of packages alternately, locations of the bands in the vertically stacked packages which are loaded on the pallet are different from an upper location of the stringers and the entries for inserting the fork of the fork lift truck by loading the two kinds of packages alternately.

2. The building boards loading structure as recited in claim 1, wherein the bands are a resin-made film, a resin-made band or a combination thereof.

* * * * *